US008622746B2

(12) United States Patent
Gholami-Shabani et al.

(10) Patent No.: US 8,622,746 B2
(45) Date of Patent: Jan. 7, 2014

(54) BUOYANT DEVICE FOR TEACHING AND TRAINING

(75) Inventors: Farhad Gholami-Shabani, Markham (CA); Dianne Beverly Croteau, Toronto (CA)

(73) Assignee: Farhad Gholami-Shabani, Markham (CA)

( * ) Notice: Subject to any disclaimer, the term of this patent is extended or adjusted under 35 U.S.C. 154(b) by 174 days.

(21) Appl. No.: 13/310,457

(22) Filed: Dec. 2, 2011

(65) Prior Publication Data

US 2013/0143189 A1 Jun. 6, 2013

(51) Int. Cl.
*A63B 69/10* (2006.01)

(52) U.S. Cl.
USPC ..... 434/254

(58) Field of Classification Search
USPC ..... 404/254
See application file for complete search history.

(56) References Cited

U.S. PATENT DOCUMENTS

| | | | | | |
|---|---|---|---|---|---|
| 2,718,644 | A | * | 9/1955 | Barr | 441/56 |
| 2,935,751 | A | * | 5/1960 | Emmick et al. | 441/114 |
| 3,044,184 | A | * | 7/1962 | Freeman | 434/29 |
| 3,425,072 | A | * | 2/1969 | Carlson | 441/114 |
| 3,771,182 | A | * | 11/1973 | Lind | 441/88 |
| 4,662,781 | A | * | 5/1987 | Tinkler | 405/79 |
| 4,804,326 | A | * | 2/1989 | Lennon | 434/254 |
| 4,861,301 | A | * | 8/1989 | Pomeroy et al. | 441/131 |
| 5,171,178 | A | * | 12/1992 | Creek et al. | 441/132 |
| 5,184,968 | A | * | 2/1993 | Michalochick et al. | 441/116 |
| 5,258,409 | A | * | 11/1993 | Gay | 514/642 |
| 5,342,232 | A | * | 8/1994 | Bardot | 441/115 |
| 5,393,230 | A | * | 2/1995 | Vizintin et al. | 434/254 |
| 5,413,485 | A | * | 5/1995 | Adee | 434/254 |
| 5,588,891 | A | * | 12/1996 | Bardot | 441/115 |
| 5,628,633 | A | * | 5/1997 | Lehman | 434/265 |
| 5,700,173 | A | * | 12/1997 | Lerro | 441/57 |
| 5,706,762 | A | * | 1/1998 | Dokken | 119/712 |
| 5,846,087 | A | * | 12/1998 | Scherer | 434/270 |
| 6,089,936 | A | * | 7/2000 | Hoffman | 441/117 |
| 6,500,009 | B1 | * | 12/2002 | Brault et al. | 434/265 |
| 6,659,825 | B2 | * | 12/2003 | Foss | 441/123 |
| 6,666,622 | B1 | * | 12/2003 | Courtney et al. | 405/186 |
| 6,749,475 | B2 | * | 6/2004 | Howerton | 441/132 |
| 6,805,519 | B1 | * | 10/2004 | Courtney | 405/185 |
| 6,929,521 | B2 | * | 8/2005 | Howerton | 441/132 |
| 6,948,991 | B2 | * | 9/2005 | Zhao | 441/123 |
| 7,150,668 | B2 | * | 12/2006 | Kemp | 441/106 |
| 7,247,027 | B2 | * | 7/2007 | Hoster, Jr. | 434/262 |
| 8,025,541 | B2 | * | 9/2011 | Churchill et al. | 441/40 |
| 8,453,608 | B2 | * | 6/2013 | Lind | 119/707 |
| 2009/0311047 | A1 | * | 12/2009 | Martin | 405/63 |
| 2012/0208159 | A1 | * | 8/2012 | Coulombe | 434/254 |

* cited by examiner

OTHER PUBLICATIONS

Photo of product as shown at OCAD Graduation Show: May 6-May 9, 2010.

*Primary Examiner* — Kurt Fernstrom
*Assistant Examiner* — Dolores Collins
(74) *Attorney, Agent, or Firm* — Wilfred P. So; Blake, Cassels & Graydon LLP.

(57) ABSTRACT

A teaching aid is provided for use in swim training. The teaching aid comprises a unitary body that is approximately U-shaped. The body defines an opening adapted to receive a torso of a swimmer. The body further comprises a pair of end portions, each of which is tapered to a rounded tip. The end portions further comprise inward-facing fins. A method using a teaching aid for a variety of swimming techniques including front kick, back kick, starfish, doggy paddle, front crawl, back crawl, elementary back, breaststroke, dolphin kick and egg-beater kick is also provided. A method of using the teaching aid and a method of providing instructions to a swimmer to use the teaching aid are also provided.

21 Claims, 22 Drawing Sheets

Front kick

Back kick

Starfish front & back

Doggy paddle

Front crawl

Back crawl

Elementary back

Breaststroke

Dolphin kick

Eggbeater kick

BUOYANT DEVICE FOR TEACHING AND TRAINING

TECHNICAL FIELD

The following relates generally to a buoyant device for teaching and training swimmers.

BACKGROUND

Teaching aides are used to teach a variety of subjects and activities including sports. Swimming is an activity where teaching aides can be of particular utility. Swimming is a common recreational activity as well as a competitive sport. Swimming may be taught formally in a class or may be taught in an informal setting.

Learning to swim may be distressing, difficult and dangerous to a swim trainee due to the perceived or real risk of drowning. Providing a student with an effective teaching aid may reduce the nervousness of the student and help to increase the student's focus. The teaching aid may help the student develop specific techniques of movement in the water and techniques for respiration while swimming. A teaching aid for swimming may also help a swimming student overcome fear and enable a student to assume a position and begin to learn a swimming stroke that may be difficult without a buoyant aid.

Several types of aides exist to aid students in learning to swim. Examples of these aides include substantially flat flutter boards, which are typically composed of a foam and buoy the student during kicking-type exercises. Flutter boards, for example, may be difficult to grasp while practicing kicking strokes and uncomfortable to rest on. Other flotation devices, for example, pool noodles, do not hold a solid form, are unwieldy when practicing many types of strokes, and are not comfortable when supporting the swimmer's body.

BRIEF DESCRIPTION OF THE DRAWINGS

Embodiments will now be described by way of example only with reference to the appended drawings wherein.

DETAILED DESCRIPTION OF THE DRAWINGS

Figure 1:
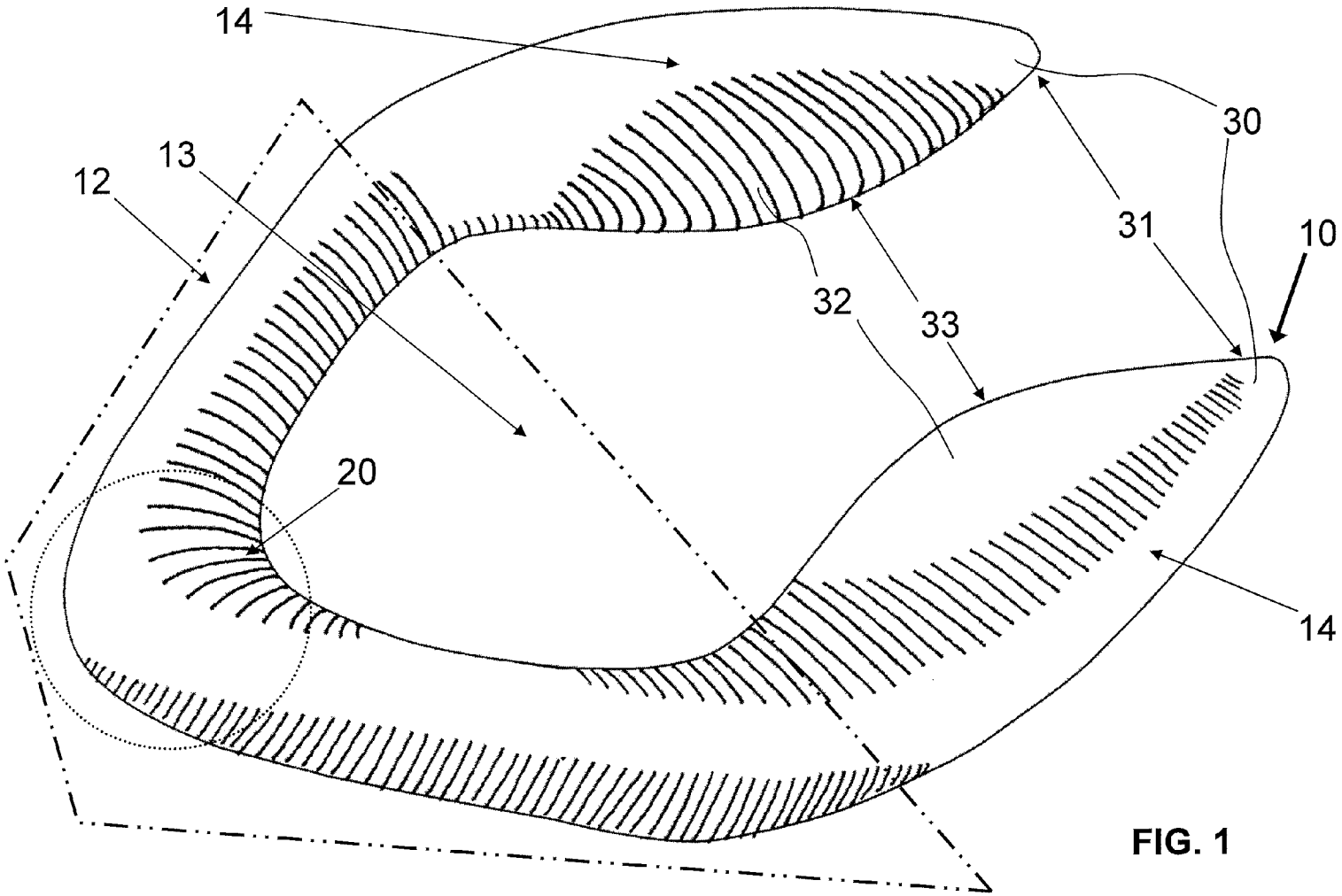
FIG. 1 is a perspective view of an example buoyant teaching aid.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practised without these specific details. In other instances, well-known methods, procedures and components have not been described in detail so as not to obscure the example embodiments described herein.

Also, the description is not to be considered as limiting the scope of the example embodiments described herein. For example, reference is made to using the teaching aid to perform certain swimming techniques. This application is used as an example and the principles outlined herein are applicable to other swimming techniques.

To provide helpful instruction, the swimming instructor may provide a clear visual image of proper technique to the swimming trainee. It may be difficult for swim trainees to perform proper techniques using currently available teaching aides, as it may be difficult to find a correct portion of the teaching aid to grasp while performing a swimming technique. Currently available teaching aids may also not be comfortable for a swim trainee. These teaching aids may afford the trainee too much or too little support in the water. Currently available teaching aids may also be difficult to quickly wear or remove and may provide a trainee with too much or insufficient support in the water. Furthermore, teaching aids currently in use may prevent a swim trainee from performing a swim technique in proper form.

Turning to FIG. 1, a buoyant teaching aid 10 for training swimmers is shown. The teaching aid 10 is a substantially U-shaped and comprises two end portions 14 attached to a front portion 12. The front portion 12 comprises a union 20 located at the base of the U-shape.

In an example embodiment, the union 20 may be enlarged with respect to the rest of the front portion. The distal end of each of the end portions 14 tapers to a rounded tip 30. Each end portion 14 also tapers toward an inwardly facing fin 32. The end portions 14 may be thinner than the front portion 12. Each of the two end portions 14 tapers toward the inwardly facing fin 32 in a smooth transition. Each fin 32 may be significantly thinner than the outer perimeter of the U-shaped teaching aid 10, as is further described below.

Spacing between the inwardly facing fins 32 is referred to as the fin spacing 33. The fin spacing 33 is sufficiently large to allow the torso of a swim trainee 10 to pass between the fins. The end portions 14 of the teaching aid 10 define an opening, referred to herein as the central cavity 13, which is located between the two end portions 14. The central cavity 13 may be sufficiently large to receive the torso of a swim trainee.

A spacing defined by the distance between a first of the rounded tips 30 and a second of the rounded tips 30 is herein after referred to as the tip spacing 31 and may be sufficiently large to allow a torso of a swim trainee to fit through the tip spacing 31 and into the central cavity 13.

Figure 2:
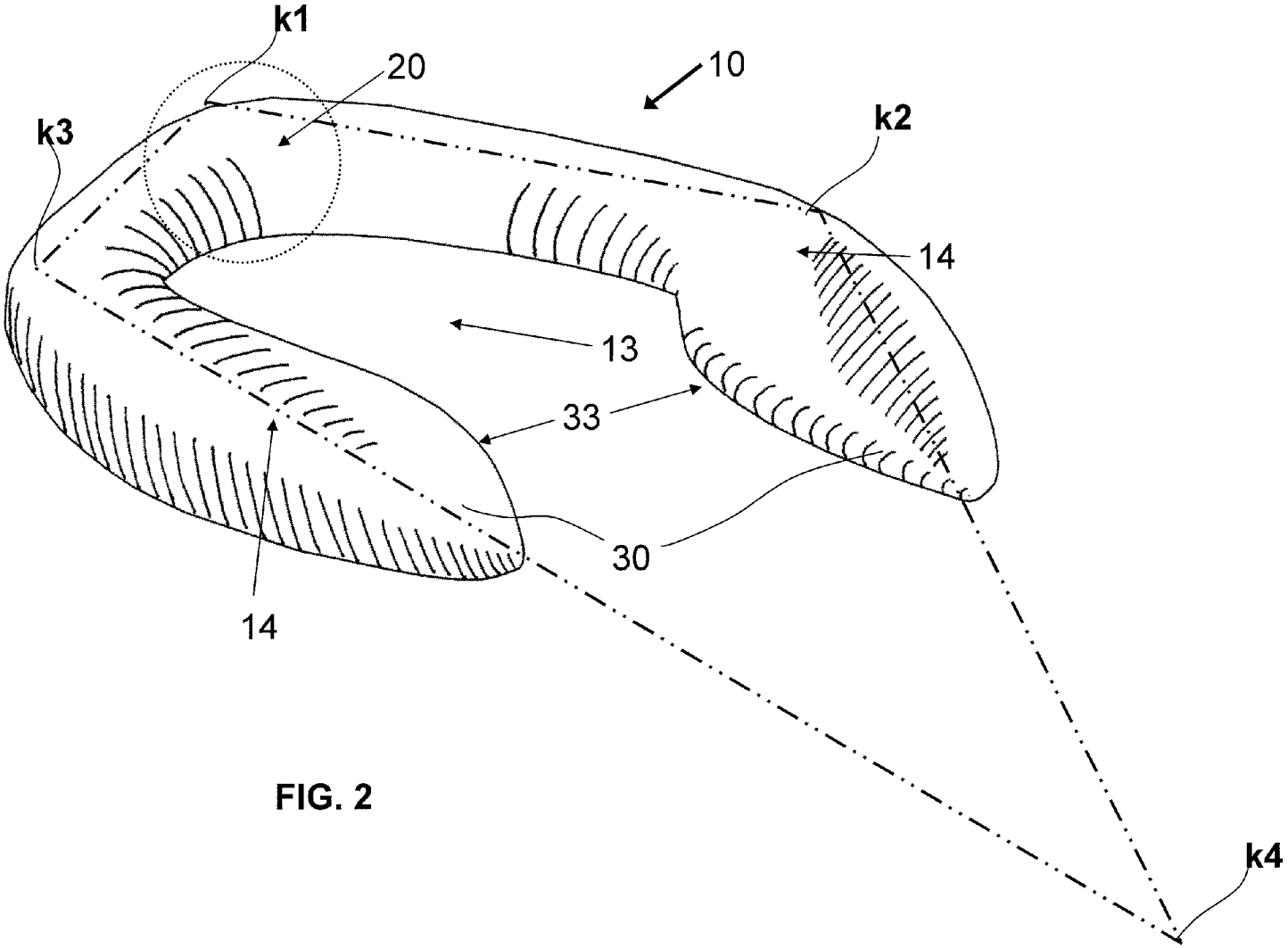
FIG. 2 is a perspective view of the teaching aid of FIG. 1 from a different vantage point.

As can be seen in FIG. 2, the outer perimeter of the teaching aide 10 corresponds approximately to the shape of a kite K. By way of background, a kite shape refers to a quadrilateral with two pairs of adjacent equal length sides. A kite shape is used herein as a reference to help describe the shape of the teaching aide 10. A union 20 is located on the front portion 12 of the teaching aide 10. The union 20 may be an area of increased thickness in the body of the teaching aide 10, and may be adapted to provide a greater level of buoyant force. The union 20 is located on the first corner k1 of kite K. The second corner k2 and third corner k3 of kite K are located at opposite junctions between the front portion 12 and each of the end portions 14. The fourth corner k4 of kite K is located opposite to k1 and off of teaching aide 10. End portions 14 of the teaching aide 10 are tapered to a rounded tip 30 at the distal end of each end portion 14. The fourth corner k4 sits approximately at the intersection of lines k2-k4 and k3-k4 of the kite, which extend down and in the direction of each end portion 14 past each of the rounded tips 30.

From FIG. 2, it can be seen that the tip spacing 31 and the fin spacing 33 is narrower than the central cavity 13. A swim trainee's torso may be fit through the tip spacing 31 and the fin spacing 33 and slide into the central cavity 13. The narrower fin spacing 33 may provide the swim trainee with more stability and may provide support surrounding the swim trainee's torso. Furthermore, by enabling the swim trainee to slide the teaching aid 10 around the torso, the swim trainee may avoid having to pass the teaching aid 10 over the swim trainee's head. For the teaching aide to fit the swim trainee's torso, the swim trainee may slide the teaching aid 10 around the torso by first sliding the torso through the tip spacing 31 then through the fin spacing 33 and into the central cavity 13.

In some embodiments, the fin spacing 33 is sufficiently narrow to prevent a swim trainee from slipping out of the central cavity while facing toward or away from the union 20. The tip spacing 31, fin spacing 33, size of the central cavity 13 and other aspects of the teaching aid 10 may be adapted based on the size of the swim trainee for which the teaching aid 10 is designed.

Figure 3:
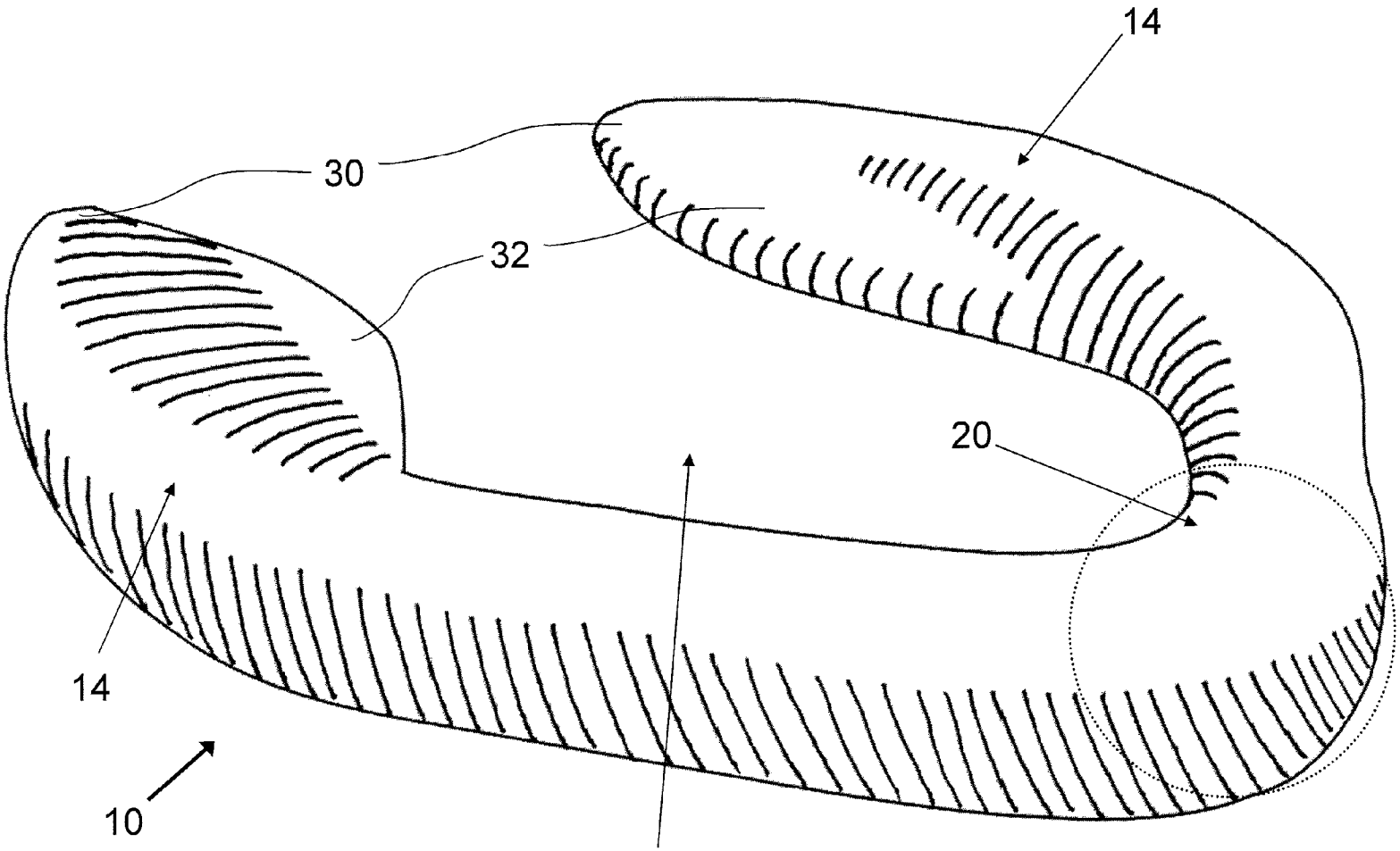
FIG. 3 is a perspective view of the teaching aid of FIG. 1 from another vantage point.

As can be seen in FIG. 3, the front portion 12 of the teaching aid 10, as was outlined in FIG. 1, is substantially rounded. The union 20 may be of increased thickness in comparison to the surrounding front portion 12 to provide a greater level of buoyant force. The teaching aid 10 may be designed for a swim trainee of a particular age, height, weight, or other measure of body size. The thickness of the union 20 may be determined as a design consideration based on the weight and size of an age group of swim trainee for which the teaching aid 10 is designed.

The teaching aid 10 is buoyant due to its characteristic density, which is lower than the density of water. In one example embodiment, the teaching aid 10 is blow moulded from a polymer. By forming sections of the teaching aid 10 with higher volume, the buoyancy of various portions of the teaching aid 10 may be balanced for various aquatic exercises. For example, an area of the teaching aid that supports more body weight may be made to be thicker to provide a higher buoyant force to the swim trainee's body in that area. The thickness of the front portion 12 of the teaching aid 10 may be thicker than the two end portions 14 to allow the front portion 12 to provide a higher buoyant force to overcome imbalance in the weight applied to each portion of the teaching aid 10 by the swim trainee.

In one example embodiment, the teaching aid 10 may have tactile features adapted to provide the swim trainee with a stronger grip on certain regions of the teaching aid 10. By covering only the regions where a swim trainee is likely to grip with a high friction texture, other areas of the teaching aide 10 may be provided with a lower friction texture, providing a swim trainee with a more comfortable experience. For example, the surface on the outer perimeter of the teaching aid may comprise a high friction texture whereas the surface on the inner perimeter of the teaching aid and the fins 32 may comprise a low friction texture. The end portions 14 may also comprise a high friction texture. The low friction texture may be adapted to come into sliding contact with, for example, the swim trainee's torso, whereas a high friction texture on the outer perimeter of the teaching aid may come into contact primarily with the swim trainee's hands.

By providing certain parts of the surface of the teaching aid 10 with a higher friction texture, the swim trainee may feel more comfortable, as the swim trainee may have a better grip of the teaching aid 10. The higher friction texture may allow swim trainee to explore holding the teaching aid 10 in various positions and with only one hand without making the swim trainee uncomfortable in the water. A high friction texture may comprise, for example, ridges, bumps, or combinations thereof.

Referring again to FIG. 3, each of the inward-facing fins 32 disposed approximately in the plane of the kite K. The fins 32 may be designed to provide an ergonomic surface upon which the body of the swim trainee can rest. The fins 32 may be adapted to also provide a comfortable gripping surface for a variety swim training exercises, as described further below.

Figure 4:
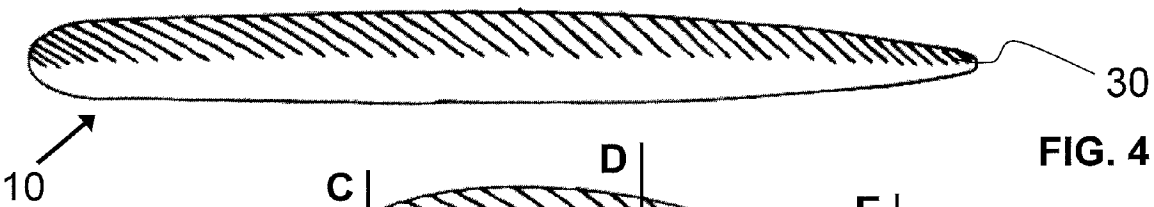
FIG. 4 is a profile view of the teaching aid of FIG. 1.

Referring now to FIG. 4, the teaching aid 10 is shown in profile view. It can be seen from FIG. 4 that the thickness of the thickest portion of the front portion 12 and the end portions 14 is approximately uniform along the length of the teaching aid 10 and tapers towards the rounded tips 30 at the distal end of the end portions 14.

Figure 5A:
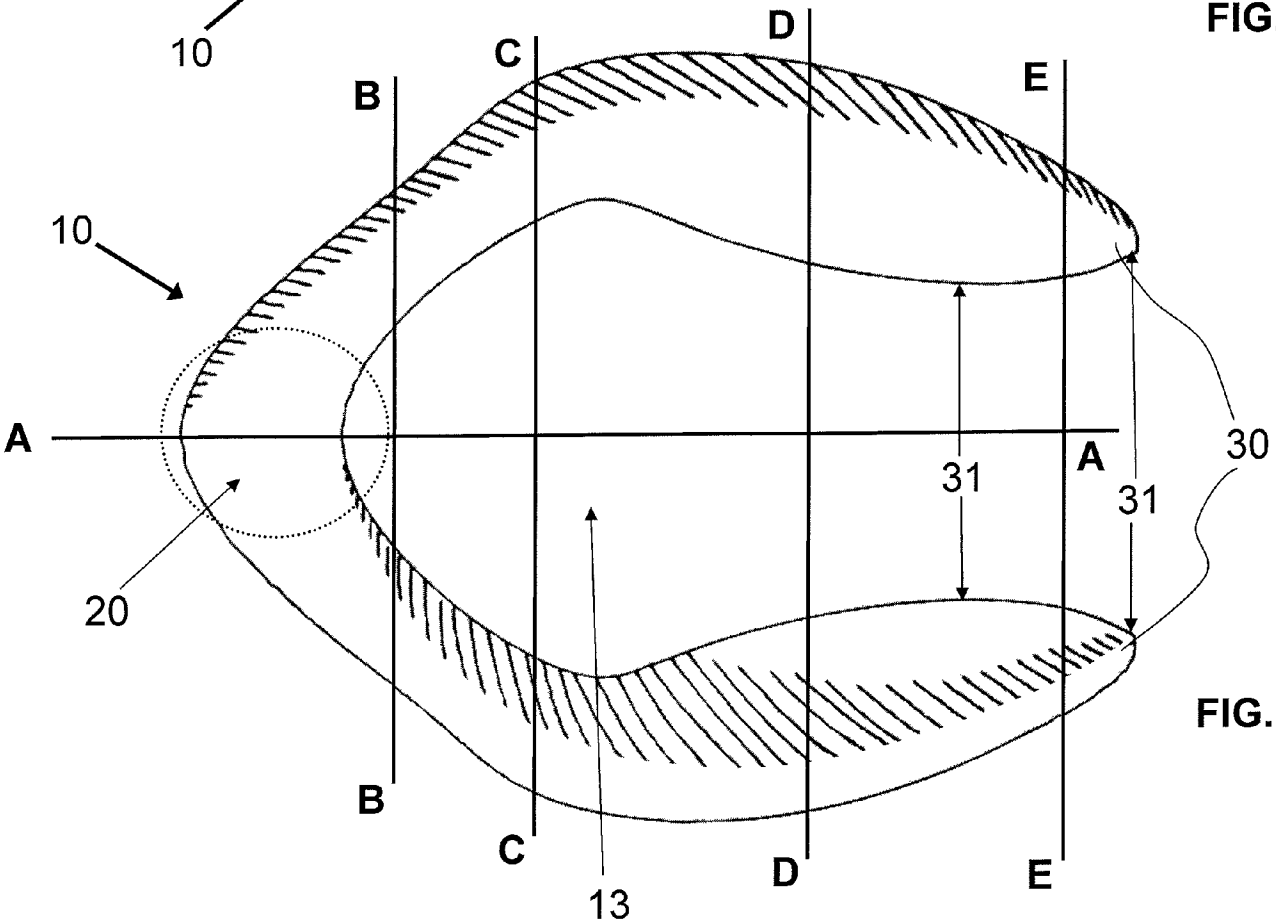
FIG. 5A is an overhead view of the teaching aid of FIG. 1.

Referring now to FIG. 5A, an overhead view of the teaching aid 10 can be seen. It can be seen that the central cavity 13 is larger than the tip spacing 31 and the fin spacing 33. With the swim trainee's torso in the central cavity 13, the swim trainee may be well supported in the water. The narrower tip spacing 31 and fin spacing 33 enable support on almost all sides of the swim trainee's torso. Increased thickness of the union portion 20, as described above can also be seen in FIG. 5A.

Figure 5B:
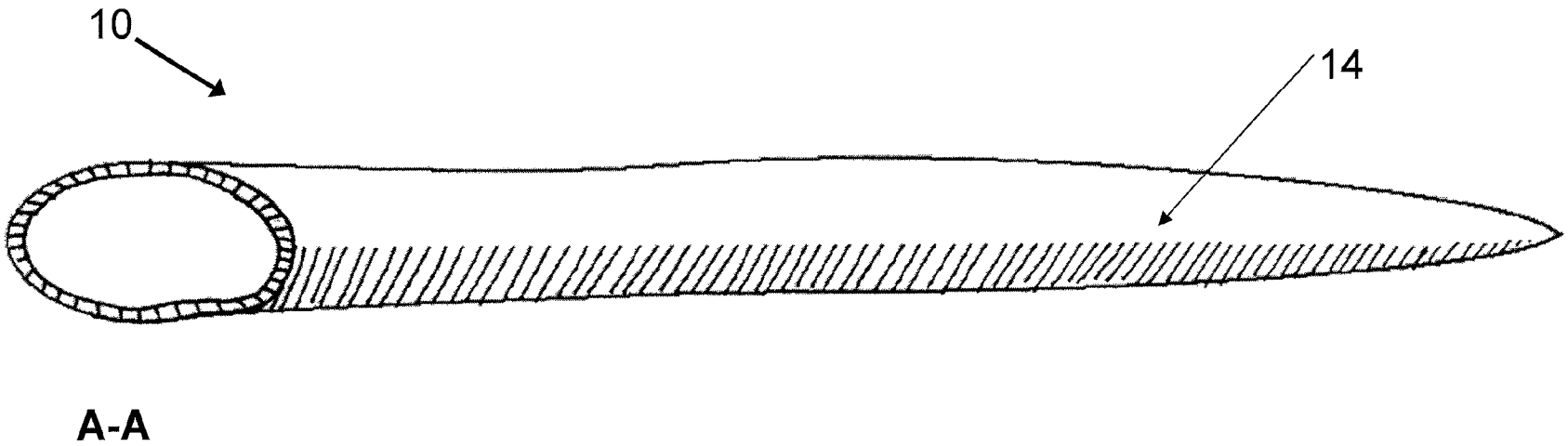
FIG. 5B is a cross-sectional view along line A-A of the teaching aid of FIG. 5A.

Turning to FIG. 5B, a section of FIG. 5A along A-A is shown. As can be seen, the teaching aid 10 may be hollow. The teaching aid 10 may be comprised of a blow-moulded buoyant unitary body. The thickness of the walls may be determined based on the polymer being used and based on the weight or a range of weights of the swim trainee for whom the teaching aid was designed.

Figure 5D:
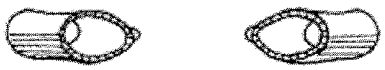
FIG. 5D is a cross-sectional view along line B-B of the teaching aid of FIG. 5A.
Figure 5C:
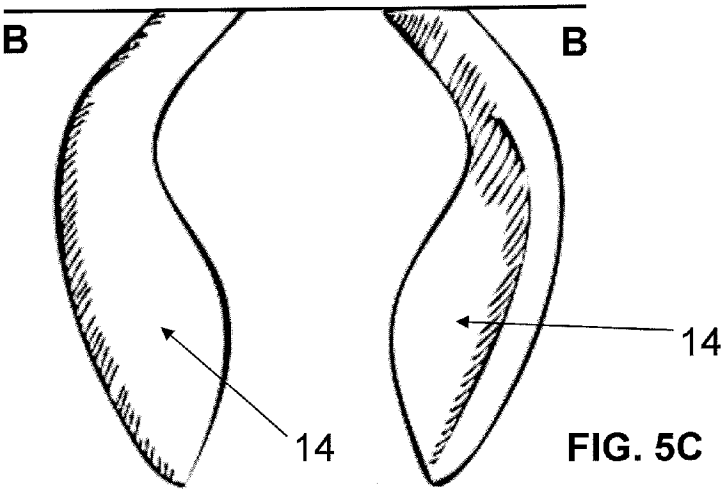
FIG. 5C is an overhead view of the teaching aid of FIG. 5A showing the teaching aid cut at line B-B.
Figure 5F:
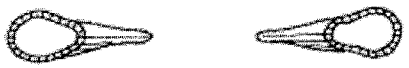
FIG. 5F is a cross-sectional view along line C-C of the teaching aid of FIG. 5A.
Figure 5E:
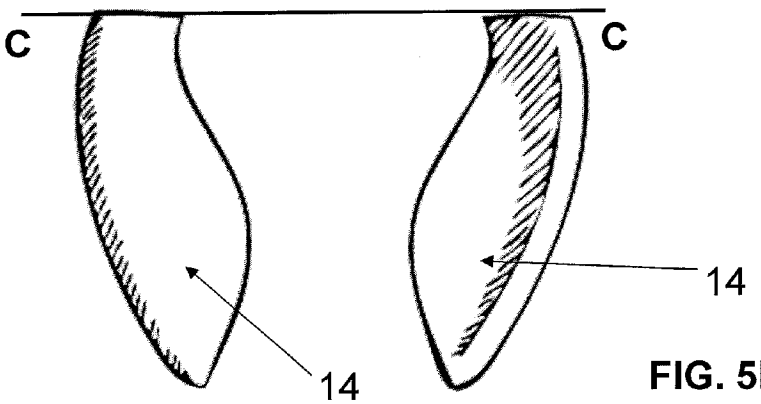
FIG. 5E is an overhead view of the teaching aid of FIG. 5A showing the teaching aid cut at line C-C.

Turning now to FIG. 5C, the location of section B-B, as can be seen in FIG. 5D, is shown. As can be seen from B-B, the cross section of the front portion 12 of the teaching aid 10 is substantially rounded. FIG. 5E shows the location of cross section C-C, which is shown in FIG. 5F. As can be seen from cross section C-C, particularly when contrasted with section B-B, at the approximate location where the front portion 12 transitions into the end portions 14, the cross section is more elongated. Though the thickness of the thickest point is relatively unchanged with respect to B-B, the section shows a taper toward the inner side of the end portions 14.

Figure 5G:
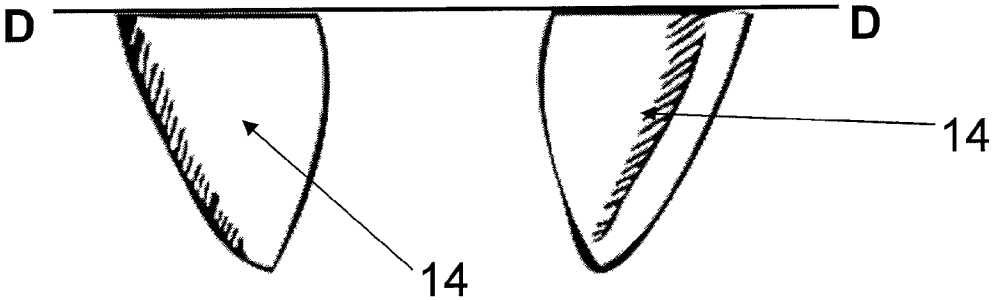
FIG. 5G is an overhead view of the teaching aid of FIG. 5A showing the teaching aid cut at line D-D.
Figure 5H:
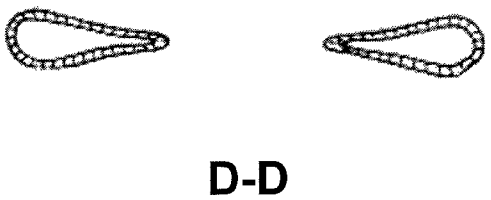
FIG. 5H is a cross-sectional view along line D-D of the teaching aid of FIG. 5A.

Referring now to FIG. 5G, the location of the D-D section is shown. The section has been taken approximately in the region where the fins 32 moved their largest point. As can be seen from FIG. 5H, the fins 32 are significantly thinner than the outer side of the end portions 14. The section along lines D-D produces approximately tear-drop shaped cross section. The section shows that the teaching aid 10 is elongated in the horizontal direction with respect to all of the previous sections of FIG. 5A. It is noteworthy that while the fins 32 are much thinner than the outer perimeter of the end portions 14, they are smoothly tapered. The smooth edges provide a more comfortable surface for the swim trainee.

Figure 5I:
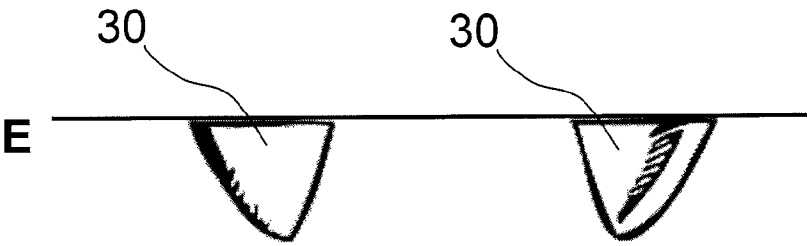
FIG. 5I is an overhead view of the teaching aid of FIG. 5A showing the teaching aid cut at line E-E.
Figure 5J:
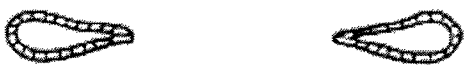
FIG. 5J is a cross-sectional view along line E-E of the teaching aid of FIG. 5A.

Turning to FIG. 5I, the location of the E-E section is shown. The sections, as seen in FIG. 5J, remain approximately tear-drop shaped; however, the fins 32 are noticeably less elongated than those visible from the D-D section. It is also noteworthy that the thickest portion of the E-E section is thinner than that in the D-D section, as the end portions 14 are tapering off.

Figures 6, 7:
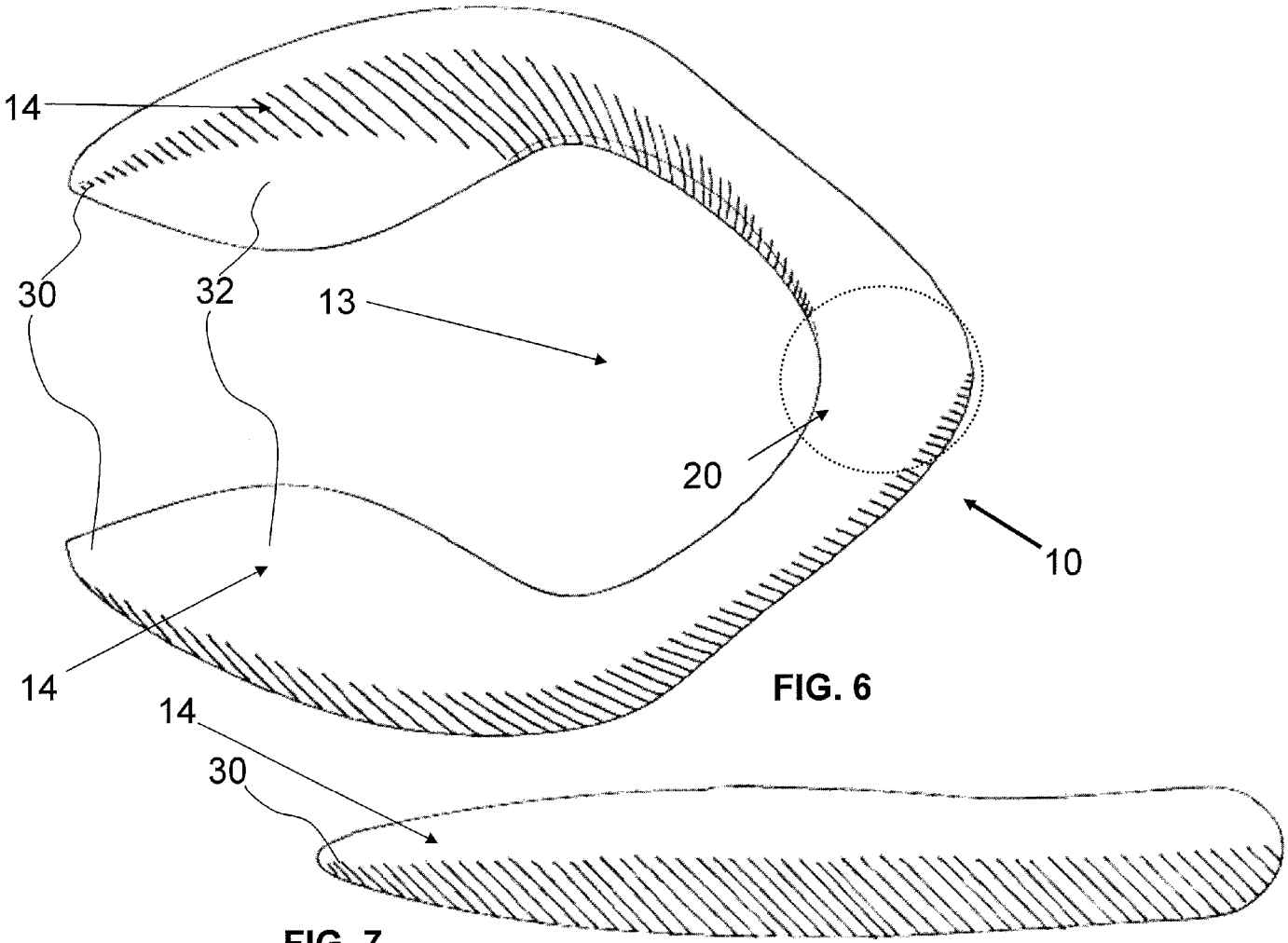
FIG. 6 is an overhead view of a buoyant teaching aid for smaller bodies.
FIG. 7 is a profile view of the teaching aid of FIG. 6.

As was mentioned above, the teaching aid 10 may be designed for various body sizes. For example, a teaching aid 10 designed for children less than twelve years old may require less buoyancy in comparison with a teaching aid 10 for adult swimmers. Some swimmers may also require more support while other swimmers may prefer a greater range of motion. Moreover, the size of the central cavity 13, the tip spacing 31 and the fin spacing 33 typically required for a child less than twelve years old is significantly smaller than the size required for most adults. In general, the size and shape of the teaching aid 10 can be optimized to suit the swim trainee. Referring to FIG. 6, an example teaching aid 10 is shown. The fins 32 are large and the fin spacing 33 is correspondingly small, providing the swim trainee with greater support in all directions. The teaching aid 10 is also relatively thick, providing a swim trainee with a large buoyant force.

Turning to FIG. 7, the teaching aid 10 of FIG. 6 is shown in profile. As can be seen from the figure, the teaching aid 10 is thick over the front portion 12 as well as a significant fraction of the end portions 14. The teaching aid 10 tapers towards blunt rounded tips 30. A teaching aid 10 as shown in FIG. 6 and FIG. 7 may be suitable for a smaller swimmer such as a child, as the central cavity 13 is small relative to the overall size of the teaching aid 10. Moreover, the teaching aid 10, provided with relatively large fins 32, provides a swim trainee with support on almost all sides, which is beneficial for a novice swim trainee (e.g. a child) who has little experience in the water. Furthermore, the buoyancy of the teaching aid 10 of FIG. 6 and FIG. 7 will be substantial due to the relatively thick front portion 12 and end portions 14. A high buoyant force will further assist the swim trainee in staying afloat and remaining calm and comfortable in the water.

Figure 8:
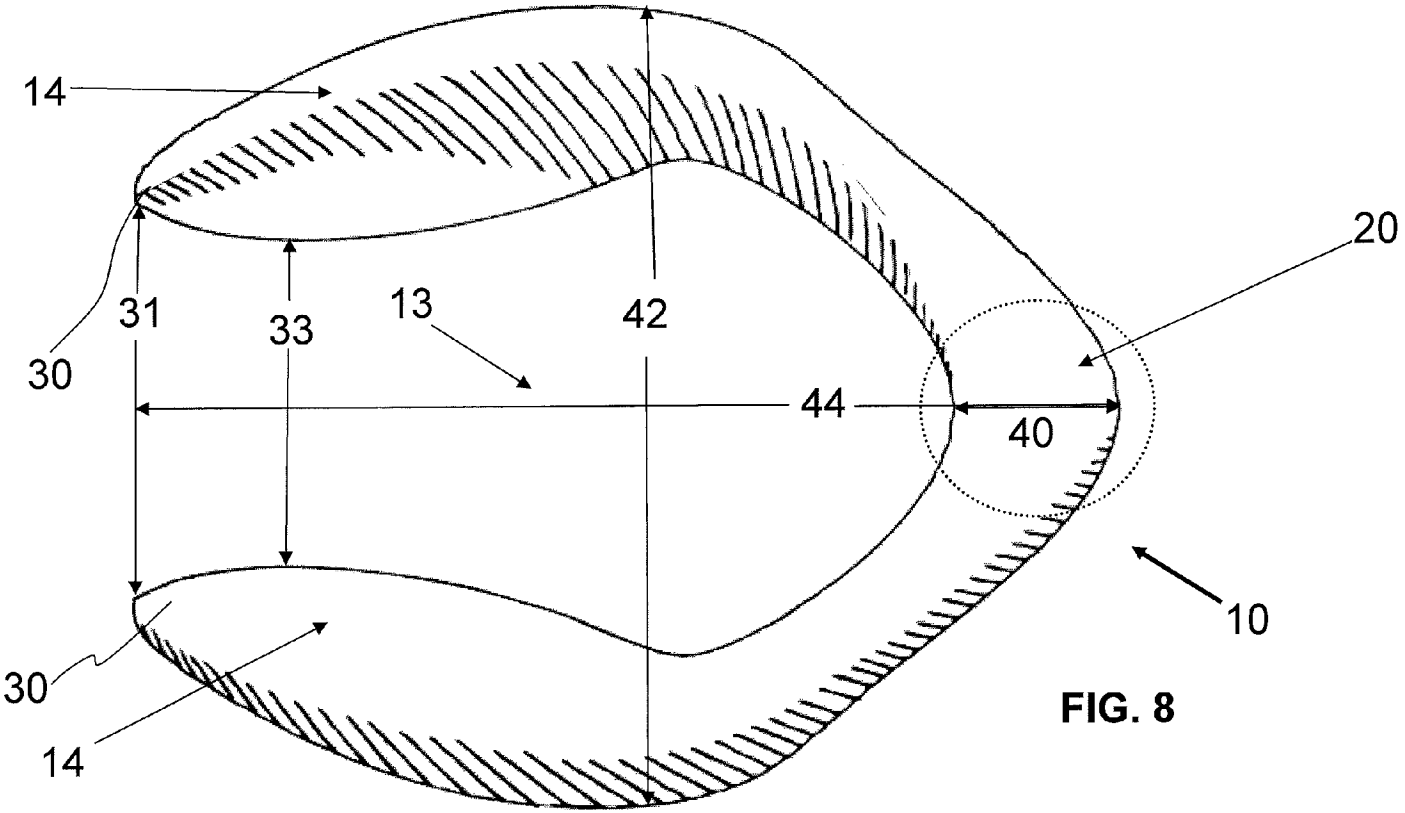
FIG. 8 is an overhead view of an example buoyant teaching aid for larger bodies.
Figure 9:
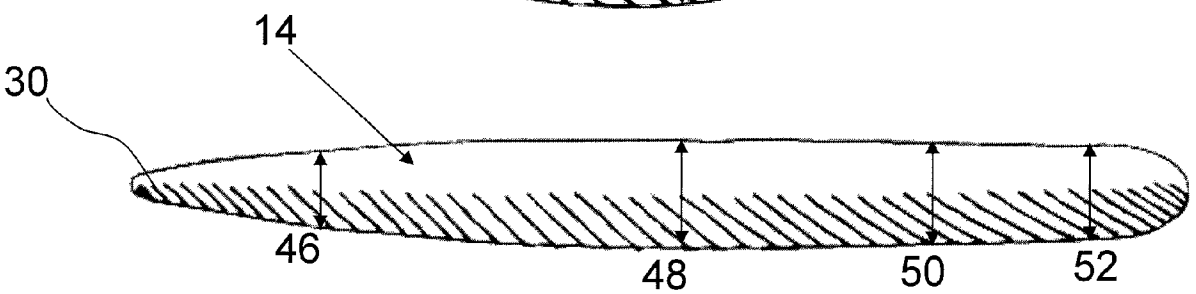
FIG. 9 is a profile view of the teaching aid of FIG. 8.

Turning now to FIG. 8, a teaching aid 10 similar to that of FIG. 6 is shown. However, the teaching aid of FIG. 8 is comparatively thinner, has smaller fins 32 and a larger central cavity 13. FIG. 9 shows the teaching aid 10 of FIG. 8 in profile, where the thickness of the teaching aid 10 is visibly less than the thickness of the previously described teaching aid 10 as shown in FIG. 7. The thinner teaching aid 10 provides less buoyant force, potentially enabling the swim trainee greater freedom of motion at the expense of flotation. The teaching aid 10 also provides less stability, as the fin spacing 33 is relatively large. A large fin spacing 33, though providing less stability, may allow larger swim trainees to slide the teaching aid 10 around their torso until they rest in the central cavity 13. A larger fin spacing 33 may also make it easier to slide the teaching aid around the swim trainee's torso. The teaching aid 10 of FIG. 8 and FIG. 9 may, for example, be better suited to a larger and more confident swimmer that is willing to sacrifice some stability and buoyancy for an increased ease of movement.

In an example embodiment of the teaching aid of FIG. 8 and FIG. 9, the tip spacing 31 may be approximately 9.5 inches, the fin spacing 33 may be approximately 7.75 inches, the width 42 may be approximately 20 inches, and the length may be approximately 20 inches. The union 20 may measure approximately 4.5 long by 3.45 inches thick. The thickness of the front portion 12 at reference numeral 50 of FIG. 9 may be approximately 2.9 inches. The thickness of the teaching aid at its widest, referred to on FIG. 9 by reference numeral 48, is approximately 3.45 inches and the thickness of the teaching aid 10 at reference numeral 46 is approximately 2.7 inches.

In the same example embodiment, the distance between the points of the kite K of FIG. 2 that corresponds to the perimeter of the teaching aid 10 are as follows. The distance between points k1 and k3 and the distance between points k1 and k2 is approximately 12 inches. The distance between point k4 and k3 and the distance between points k4 and k2 are approximately 30 inches. The distance between points k1 and k4 is approximately 37 inches.

The above measurements are given as example measurements of the approximate measurements of a swim training aid 10. The measurements are provided to give a sense of the relative dimensions of the swim training aid 10. However, various other dimensions consistent with the principles described herein also fall into the scope of the invention.

The teaching aid 10 may be used in various bodies of water. Typically, swim lessons are taught in swimming pools and hence, the teaching aid 10 may be suited to the conditions of a swimming pool. Namely, the teaching aid 10 may be resistant to chlorine, resistant to photodegradation, and resistant to bending and disintegration when being stored and utilized in the water.

The teaching aid 10 may also have a texture conducive to being easily cleaned to remove foul on the surface of the teaching aid 10. This texture may reduce the friction between the skin of the swim trainee and the teaching aid 10. As described above, if a higher coefficient of friction is desired between the skin of the swim trainee and the teaching aid 10, specific areas of the surface or the entire surface may be provided with a surface treatment to modify the surface texture and increase friction. Similarly, to decrease friction between the swim trainee and the teaching aid 10, specific areas or the entire surface of the teaching aid may be treated or coated to reduce friction. A lower coefficient of friction between the hand of the swim trainee and the teaching aid 10 may make the teaching aid more difficult for the swim trainee to grip in the proper orientation.

The teaching aid 10 may also be substantially incompressible. A blow-moulded polymer body, for example, meets the aforementioned requirements. In particular, blow-moulded polymer bodies can be made to be resistant to photodegradation and chemical degradation using polymers resistant to UV and chemicals. For example, polymers including high density polyethylene, polypropylene, and polyamides can be made to be structurally sound. Furthermore, due to the lower surface porosity in some blow-moulded polymers in comparison with foams, blow-moulded polymers are more easily cleaned and are less likely to be fouled on the surface, enabling the friction of the swimming aid 10 to be maintained for longer before cleaning is required. It can be appreciated that the high friction textures (e.g. the bumps, ridges, etc.) can be formed during the blow moulding process. For example, the textures can be part of the mould.

The teaching aid 10 may, for example, provide swim trainees with more comfort and confidence while practicing swim exercises, allow swim trainees to perform swimming exercises that may be difficult without the aid of a buoyant body, and may assist a trainer in teaching new swim techniques to swim trainees. The teaching aid 10 may allow for a swim trainee to improve sequentially from simple to more complex swimming techniques. The teaching aid 10 may be used alone by the swim trainee to practice swim techniques or may be used with a trainer or with teaching material adapted to be used with the teaching aid 10. For example, when a swim trainee is learning a new swim technique, a swim trainer may demonstrate the technique to the trainee using the teaching aid 10.

The teaching aid 10 may also be provided with swim instructions specifically adapted for the teaching aid 10. In particular, the teaching aid 10 may be provided with swim training instructions, for example, visual materials to aid swim trainees who do not have access to a swim trainer or who would like to practice training without the swim trainer. The visual materials may comprise drawings, flow charts, video, animations or any other representation of instructions to use the teaching aid 10.

Figure 10A:
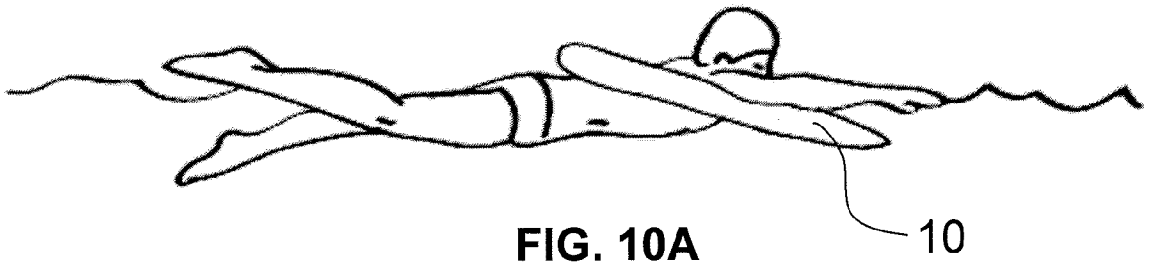
FIG. 10A is a profile view of a swim trainee performing the front kick swimming technique in a first position using the teaching aid.

Turning now to FIG. 10A, a swim trainee is shown using the teaching aid 10 to practice the front kick swimming technique in a first example position. The teaching aid 10 is placed around the torso of the swim trainee and the arms are rested on the end portions of teaching aid 10 with the swim trainee's elbows at approximately the junctions between the front portion 12 and the end portions 14. The fins 32 may also serve to support the swim trainee's arms. The surface of the opposite side of the teaching aid 10 is rested on the back of the swim trainee in the lumbar region. The teaching aid 10 buoys the upper torso of the swim trainee and allows the swim trainee to focus on leg movements without requiring the swim trainee to engage in any specific arm movements to stay afloat. The legs of the swim trainee are free to be moved upwards and downwards with respect to the water surface to impart the swim trainee with forward thrust.

Figure 10B:
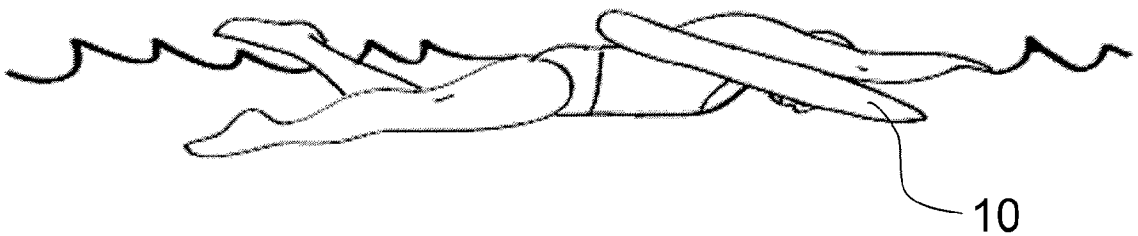
FIG. 10B is a profile view of a swim trainee performing the front kick swimming technique in a second position using the teaching aid.

FIG. 10B, shows a second example position for a swim trainee to use a teaching aid 10 to practice the front kick swimming technique. This position involves, for example, the head of the swim trainee to be submerged for a period of time to practice breathing skills. The teaching aid 10 lies on the swim trainee in approximately the same position as in the first step, illustrated above in FIG. 10A. Specifically, the front portion 12 of the teaching aid 10 lies over the swim trainee's lumbar and the swim trainee's arms rest on the end portions 14.

Figure 11A:
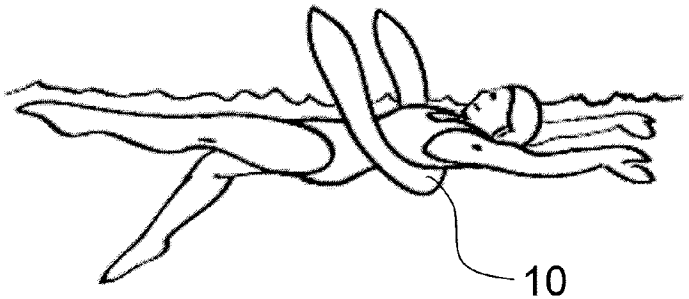
FIG. 11A is a profile view of a swim trainee performing the back kick swimming technique in a first position using the teaching aid.

Turning now to FIG. 11A, a swim trainee is shown performing the back kick training exercise using the teaching aid 10 in a first position. The teaching aid 10 assists the swim trainee in keeping afloat and respirating without ingesting water while performing the back kick exercise. The swim trainee first positions front portion 12 of teaching aid 10 behind the thorax, as shown in FIG. 11A, and lies facing upward. The swim trainee's body is supported by the teaching aid 10. The swim trainee stretches both arms straight out behind the swim trainee's head while kicking both feet to propel the swim trainee in the direction that the swim trainee's arms are pointing. The end portions 14 of the teaching aid 10 may protrude from the surface of the water. Once both arms are stretched out behind the swim trainee's head, the swim trainee pulls both hands towards the feet in an arcuate path approximately parallel to the water surface and with both palms facing the swim trainee's feet. The swim trainee may then bend both elbows and bringing both arms up to at least the shoulders, and outstretch both arms. The swim trainee may repeat these steps to impart a motive force on the water body with respect to the swim trainee.

Figure 11B:
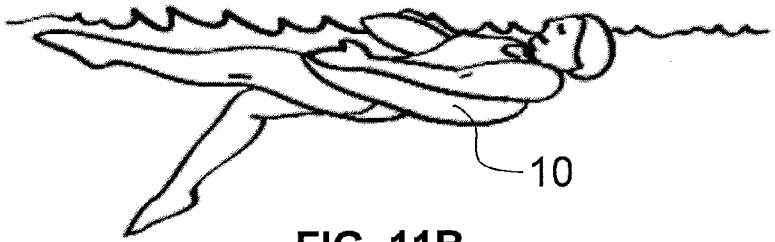
FIG. 11B is a profile view of a swim trainee performing the back kick swimming technique in a second position using the teaching aid.
Figure 11C:
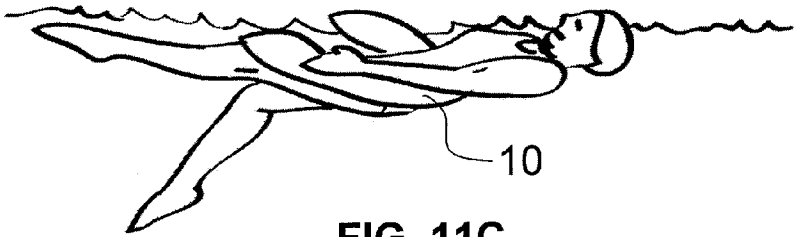
FIG. 11C is a profile view of a swim trainee performing the back kick swimming technique in a third position using the teaching aid.

A second example back kick position for the teaching aid 10 is shown in FIG. 11B. The swim trainee maintains the kicking throughout the movement of the swim trainee's arms. The front portion 12 of the teaching aid 10 remains under the swim trainee. The end portions 14 of the teaching aid 10 may be submerged. Depending on the comfort of the swim trainee, the teaching aid 10 may also be placed behind the swim trainee's lumbar, as is shown in FIG. 11C to support the swim trainee while the swim trainee performs the kicking motion.

Figure 12A:
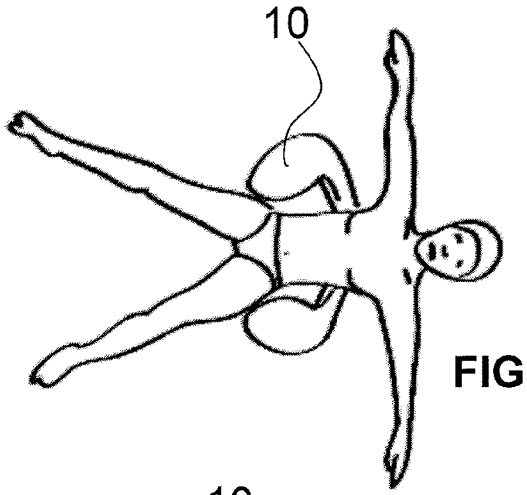
FIG. 12A is an overhead view of a swim trainee practicing the front starfish swimming technique using the teaching aid.
Figure 12C:
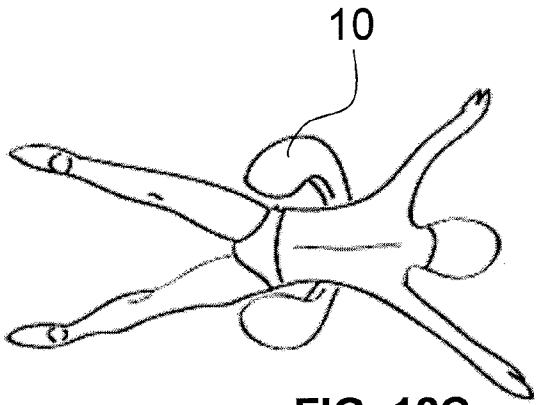
FIG. 12C is an overhead view of a swim trainee practicing the back starfish swimming technique using the teaching aid.
Figure 12B:
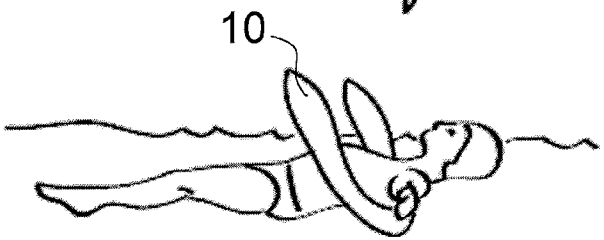
FIG. 12B is a profile view of a swim trainee practicing the front starfish swimming technique using the teaching aid.

Visual representations of instructions to perform the starfish swim exercise is shown in FIG. 12A to FIG. 12D. FIG. 12A and FIG. 12B are views of the swim trainee performing the starfish exercise while facing upward out of the water. Similarly to the back kick training exercise shown in FIG. 11A and FIG. 5B, the starfish exercise is performed by placing the front portion 12 of the teaching aid 10 behind the swim trainee's back, for example, behind the swim trainee's thorax. The end portions of the teaching aid 10 rise upward and may protrude from the surface of the water. As shown in FIG. 12A, the swim trainee's arms are then spread away from the swim trainee's body at an angle of, for example, approximately 90 degrees. The swim trainee's legs are also separated and intersect, for example, at an angle of about 45 degrees. The teaching aid 10 keeps the swim trainee's upper body afloat, as shown in FIG. 12B. The swim trainee may balance on the teaching aid 10. The swim trainee may move the trainee's arms and/or legs to maintain balance on the teaching aid 10. By keeping the upper body afloat, the swim trainee is more able to relax and breathe without ingesting water.

Figure 12D:
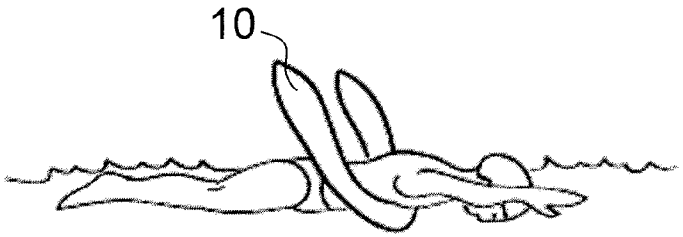
FIG. 12D is a profile view of a swim trainee practicing the back starfish swimming technique using the teaching aid.

FIG. 12C shows the swim trainee practicing the front starfish from an overhead view. The swim trainee is lying with the front portion 12 of the teaching aid 10 under the chest or abdomen, depending on the swim trainee's comfort. The end portions may protrude from the surface of the water. The swim trainee stretches the arms out, for example, at approximately a 135 degree angle from the swim trainee's body. The face of the swim trainee is below the surface of the water, as shown in FIG. 12D. The swim trainee may feel more comfortable in this position, as the swim trainee is comfortably supported by the teaching aid 10 while partially submerged in the water. Similarly to FIG. 12B, the swim trainee may balance on the teaching aid 10 using the swim trainee's arms and/or legs.

Figure 13A:
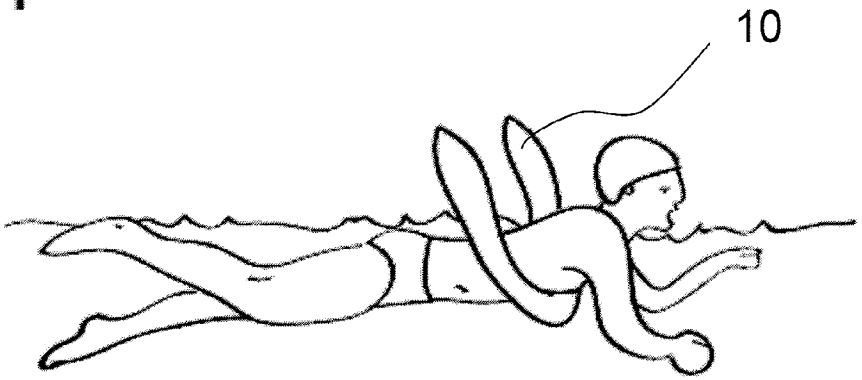
FIG. 13A is a profile view of a swim trainee performing the doggy paddle swimming technique with the head above the surface of the water using the teaching aid.

Turning now to FIG. 13A, which illustrates the swim trainee utilizing the teaching aid 10 to perform the doggy paddle swim technique. The swim trainee places the front portion 12 of the teaching aid 10 under the thorax to buoy the swim trainee throughout the exercise. The end portions 14 of the teaching aid 10 may protrude from the surface of the water on each side of the swim trainee's torso. The front portion 12 of the teaching aid provides a buoyant force to the swim trainee's torso. The swim trainee then moves both hands in an approximately circular motion, the circle lying in front of the swim trainee and perpendicular to the surface of the water. In this example, the swim trainee's hands are moving approximately 180 degrees apart in the same direction such that when the swim trainee's right hand is at its most distant point from the swim trainee's body, the swim trainee's left hand is at its closest point to the swim trainee's body.

Figure 13B:
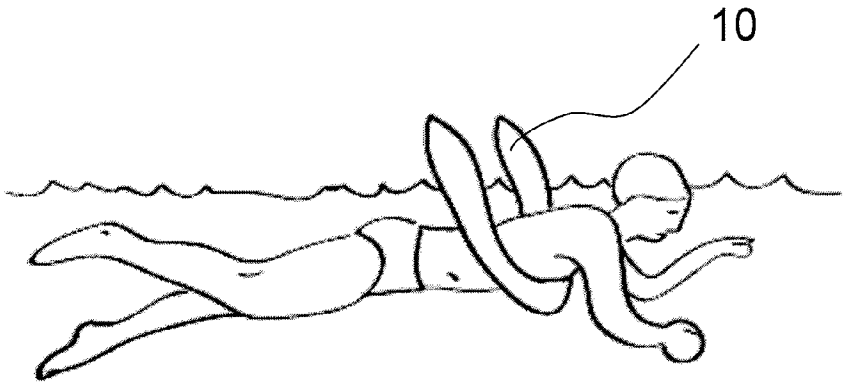
FIG. 13B is a profile view of a swim trainee performing the doggy paddle swimming technique with the head submerged using the teaching aid.

Similarly, FIG. 13B shows a swim trainee performing the doggy paddle swim technique using the teaching aid 10. However, in FIG. 13B, the swim trainee is paddling in a more hydrodynamic pose, with the head submerged below the surface of the water. In this position, the swim trainee is able to practice submerging the head under the surface of the water, a technique that is required for several other swimming strokes. In either of FIG. 13A or FIG. 13B the swim trainee may also be kicking both legs to impart a forward force to the swim trainee with respect to the water.

Figure 14A:
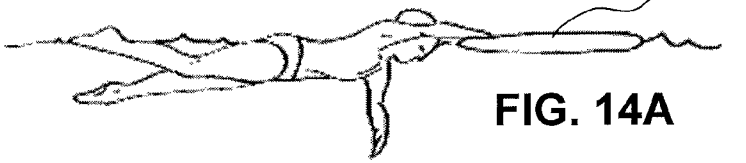
FIG. 14A is a profile view of a swim trainee performing the first step of practicing the front crawl swimming technique using the teaching aid.

A more complex swimming technique practiced using the teaching aid 10 is shown in FIG. 14A. In FIG. 14A, the swim trainee is performing the first step of the front crawl technique using the teaching aid 10. The swim trainee lays flat at the water's surface with the face submerged in the water and using both feet to kick. In the first step, the swim trainee grasps a first end portion 14 of the teaching aid 10 with the right hand while moving the left hand underneath the swim trainee's body. The swim trainee holds the teaching aid 10 out in front of the swim trainee's body and in the swim trainee's direction of travel.

Figure 14B:
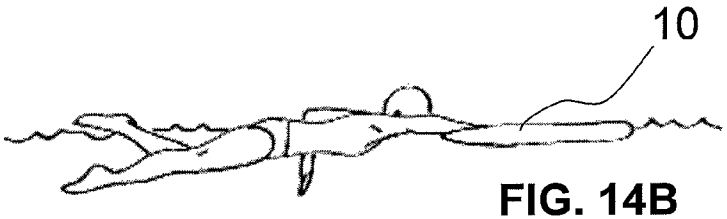
FIG. 14B is a profile view of a swim trainee performing the second step of practicing the front crawl swimming technique using the teaching aid.

By exerting a downward force on the teaching aid 10 using the right arm, the swim trainee may exert an upward force on the swim trainee's torso to keep approximately parallel to the surface of the water. In the second step, the swim trainee continues to move the hand underneath the swim trainee's body in a motion that is approximately parallel with the swim trainee's body and the water's surface, as is shown in FIG. 14B.

Figure 14C:
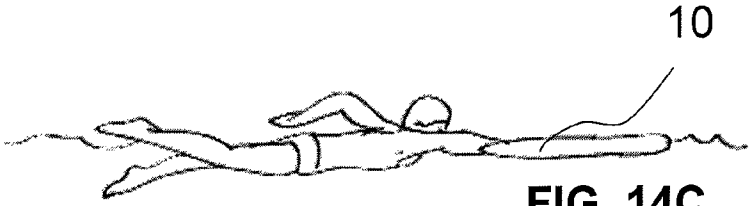
FIG. 14C is a profile view of a swim trainee performing the third step of practicing the front crawl swimming technique using the teaching aid.

In the second step, the swim trainee's right arm holds the teaching aid 10 in front of the swimmer's body in approximately the same position as in the first step. As the swim trainee's hand finishes the stroke in the third step, as shown in FIG. 14C, the swim trainee's elbow emerges from the water when the swim trainee's hand is in proximity to the swim trainee's hips and reaches for the second end portion 14 of the teaching aid 10. The swim trainee also releases the teaching aid 10 with the right hand and begins a stroke with the right hand, mirroring the stroke of the left hand in the first step.

Figure 14D:
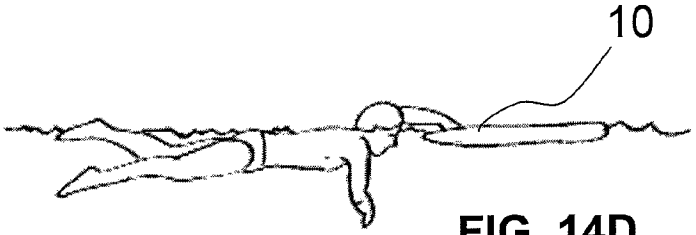
FIG. 14D is a profile view of a swim trainee performing the fourth step of practicing the front crawl swimming technique using the teaching aid.
Figure 14E:
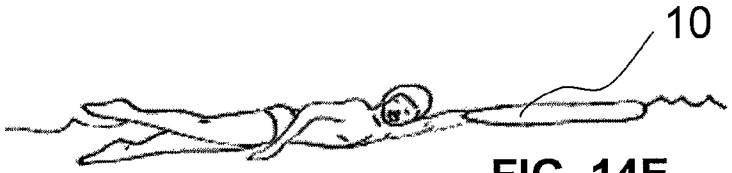
FIG. 14E is a profile view of a swim trainee performing the fifth step of practicing the front crawl swimming technique using the teaching aid.
Figure 14F:
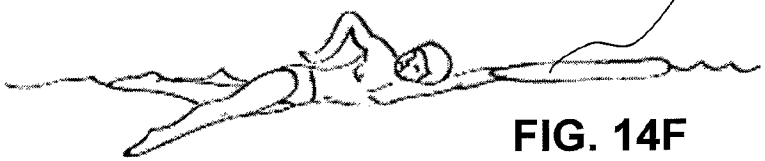
FIG. 14F is a profile view of a swim trainee performing the sixth step of practicing the front crawl swimming technique using the teaching aid.

In the fourth step, the swim trainee then completes the stroke by swinging the left arm around and grasping the teaching aid 10 on the second end portion 14, as shown in FIG. 14D. The swim trainee may begin to exert a forward and downward force on the second end portion 14 of the teaching aid 10 with the left hand while the right hand completes the stroke. The swim trainee releases the teaching aid with the right hand and continues a stroke in steps 5, 6 and 7 that mirror the stroke described in FIG. 14A, FIG. 14B and FIG. 14C. In the fifth step, the swim trainee, while grasping the second end portion 14 of the teaching aid 10 with the left hand, moves the right arm down the rest of the body, as illustrated in FIG. 14E and takes a breath to the right side.

Figure 14G:
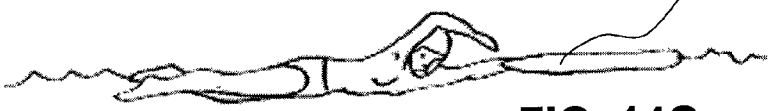
FIG. 14G is a profile view of a swim trainee performing the seventh step of practicing the front crawl swimming technique using the teaching aid.

To complete the stroke, the swim trainee removes the right arm from the water in the sixth step, illustrated in FIG. 14 and FIG. 14G while maintaining a grip on the teaching aid 10. The swim trainee then grasps the teaching aid 10 with the right hand and releases the teaching aid 10 with the left hand. The swim trainee repeats steps one to seven, as illustrated in FIG. 14A to FIG. 14G to perform the front crawl with assistance from the teaching aid 10.

Figure 14H:
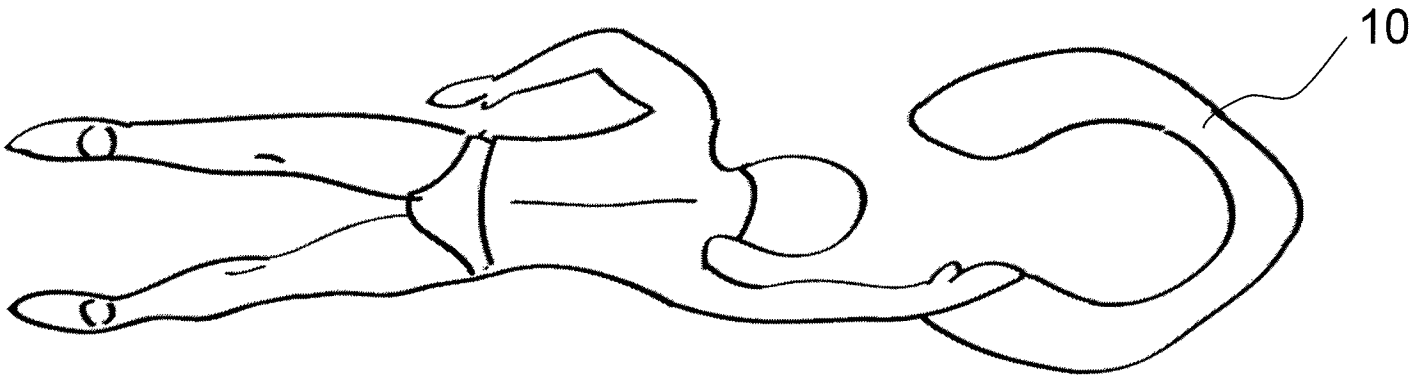
FIG. 14H is an overhead view of a swim trainee performing the third step of practicing the front crawl swimming technique using the teaching aid.

FIG. 14H shows an overhead view of the swim trainee performing the front crawl swimming technique. As can be seen from the figure, the swim trainee's right arm is grasping at a fin 32 on a first end portion 14 of the teaching aid 10. The swim trainee's other hand completes the stroke, as is explained above, before the swim trainee exchanges gripping hands. Note that the swim trainee's arm is approximately completely outstretched and that the fin 32 provides the swim trainee with an advantageous gripping surface.

The back crawl, as illustrated in FIG. 15A to FIG. 15J is also carried out by grasping a first end portion 14 of the teaching aid 10 with a first hand while kicking with both feet and paddling with the second hand. The swim trainee then grips the second end portion 14 with the second hand and proceeds to use the first hand to perform the stroke.

Figure 15A:
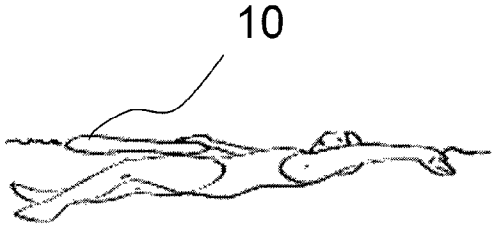
FIG. 15A is a profile view of a swim trainee performing the first step of practicing the back crawl swimming technique using the teaching aid.

The back crawl is performed lying face up at the surface of the water. As shown in FIG. 15A, the swim trainee, in the first step, grasps a first end portion 14 of the teaching aid 10 with the right hand and holds the teaching aid 10 approximately over the swim trainee's legs. The swim trainee may exert a downward force on the teaching aid 10 to support and buoy the swim trainee in the water. Concurrently, the swim trainee reaches directly backward, behind the head, with the left hand to place the left hand in a position ready to begin a swim stroke adapted to propel the swim trainee in the water.

Figure 15B:
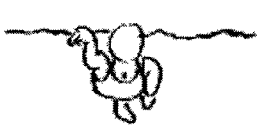
FIG. 15B is a front view of a swim trainee performing the first step of practicing the back crawl swimming technique using the teaching aid.

FIG. 15B shows an orthographic projection of the swim trainee performing the first step of the back crawl, as shown in FIG. 15A. In the first step, the swim trainee's left arm is extended almost completely backward before the swim trainee begins an arcuate movement with the left hand. The swim trainee maintains a grip on the teaching aid 10 throughout the back crawl swim exercise, as depicted in FIG. 15A to FIG. 15J.

Figure 15G:
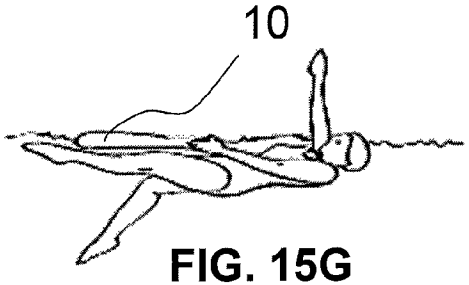
FIG. 15G is a profile view of a swim trainee performing the fourth step of practicing the back crawl swimming technique using the teaching aid.
Figure 15H:
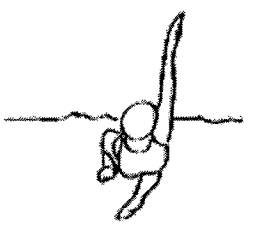
FIG. 15H is a front view of a swim trainee performing the fourth step of practicing the back crawl swimming technique using the teaching aid.
Figure 15C:
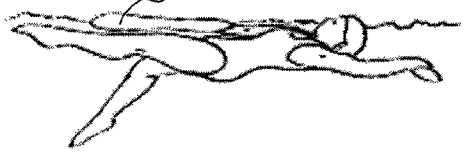
FIG. 15C is a profile view of a swim trainee performing the second step of practicing the back crawl swimming technique using the teaching aid.
Figure 15D:
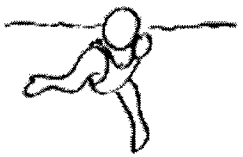
FIG. 15D is a front view of a swim trainee performing the second step of practicing the back crawl swimming technique using the teaching aid.
Figure 15I:
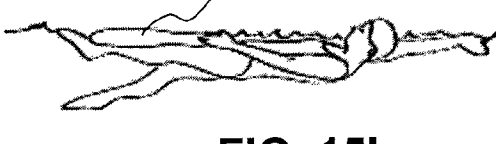
FIG. 15I is a profile view of a swim trainee performing the fifth step of practicing the back crawl swimming technique using the teaching aid.

Turning now to FIG. 15C, the swim trainee is shown in a similar position to that in FIG. 15A, however, the swim trainee's left arm has commenced an arcuate stroke alongside the swim trainee's body. As in FIG. 15A, the swim trainee maintains his grip on the end portion 14 of the teaching aid with the right hand. As is more clear in FIG. 15D, which is an orthographic projection similar to FIG. 15B, the swim trainee's left arm has moved away from behind the swim trainee's head to a position along an arcuate path toward the swim trainee's lower body. The swim trainee's hand forces water approximately away from the swim trainee's direction of travel, which consequently provides a force in the swim trainee's direction of travel.

Figure 15J:
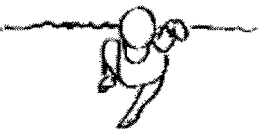
FIG. 15J is a front view of a swim trainee performing the fifth step of practicing the back crawl swimming technique using the teaching aid.
Figure 15E:
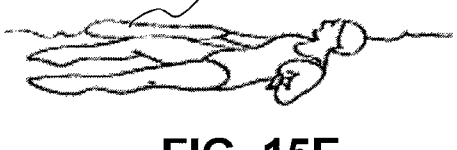
FIG. 15E is a profile view of a swim trainee performing the third step of practicing the back crawl swimming technique using the teaching aid.
Figure 15F:
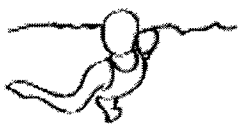
FIG. 15F is a front view of a swim trainee performing the third step of practicing the back crawl swimming technique using the teaching aid.

As can be seen from FIG. 15E and FIG. 15F, the swim trainee continues the stroke with the left hand while gripping the teaching aid 10 with the right hand. However, the swim trainee begins to release the first end portion 14 of the teaching aid 10 with the right hand and reaches for the second end portion 14 of the teaching aid 10 with the left hand. When the swim trainee's left hand is approximately aligned with the swim trainee's shoulders, the swim trainee's left arm is outstretched from the swim trainee's body at approximately half the stroke.

Once the swim trainee has completed the stroke with the left arm, the swim trainee grips the second end portion 14 of the teaching aid 10 with the left hand and releases the first end portion 14 of the teaching aid 10 with the right hand, as shown in FIG. 15G. The teaching aid 10 is maintained approximately over the swim trainee's legs or in proximity to the water over swim trainee's legs. The swim trainee then brings the right arm up and out of the water, as best seen in FIG. 15H before returning to the mirror position of FIG. 15A, wherein the swim trainee's right arm is outstretched behind the swim trainee while the left arm grips the second end portion 14 of teaching aid 10. As seen in FIG. 15J, the swim trainee's arm is in the mirror position of FIG. 15B. The swim trainee then repeats the process as shown in FIG. 15A to FIG. 15J.

Figure 15K:
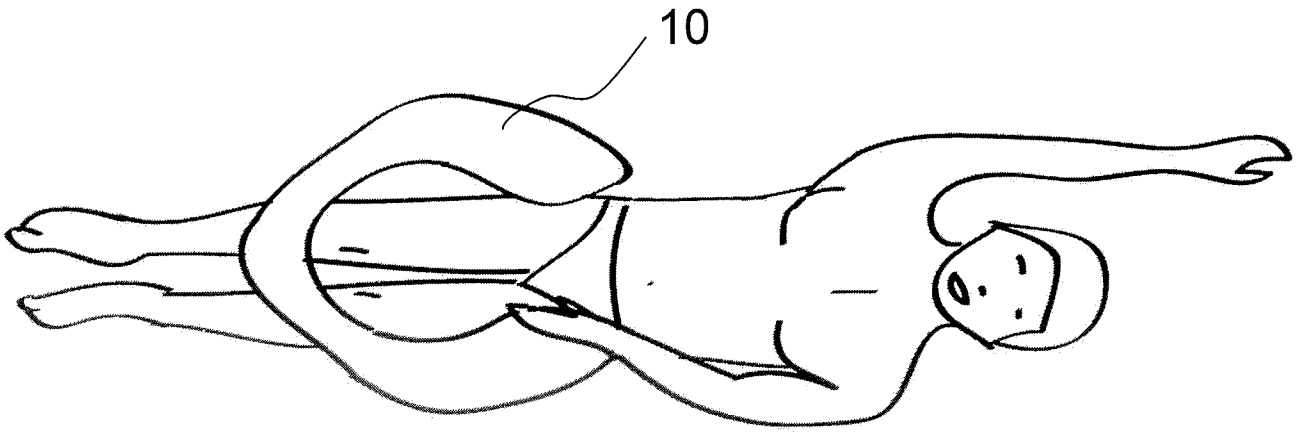
FIG. 15K is an overhead view of a swim trainee performing the fifth step of practicing the back crawl swimming technique using the teaching aid.

FIG. 15K shows an overhead view of the swim trainee gripping a first end portion 14 of the teaching aid 10 with the left hand. The tips 30 of the end portions 14 are approximately at the swim trainee's waist. The swim trainee may make use of the fins 32 if the swim trainee finds them to provide an advantageous gripping surface.

Figure 16A:
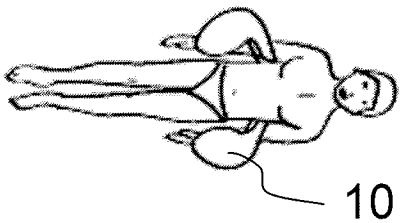
FIG. 16A is an overhead view of a swim trainee performing the first step of practicing the elementary back swimming technique using the teaching aid.

Another stroke performed while the swim trainee is lying face up near the surface of the water is the elementary back stroke. As seen in FIG. 16A, in the first step of the elementary back stroke, the swim trainee is supported by the teaching aid 10. The front portion 12 of the teaching aid 10 is placed under the lumbar of the swim trainee and both of the swim trainee's arms lay approximately parallel to the swim trainee's body and are outside the teaching aid 10. The teaching aid 10 may protrude form the surface of the water. In FIG. 16B it can be seen that the teaching aid 10 buoys the swim trainee's body close to the surface of the water. As is best seen in FIG. 16A, the swim trainee's legs begin the stroke extended and approximately parallel, without the knees significantly bent.

Figure 16C:
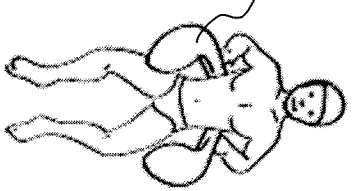
FIG. 16C is an overhead view of a swim trainee performing the second step of practicing the elementary back swimming technique using the teaching aid.

As the swim trainee progresses to the second step of the elementary back stroke, the swim trainee moves each hand toward each shoulder, as can be seen from FIG. 16C. The swim trainee bends both elbows downwards, as can be seen from the side view in FIG. 16D. Both of the swim trainee's legs are bent at the knees and separated, forming an approximately 150 degree angle at the knees, as can be seen from FIG. 16C. The swim trainee's body continues to be supported by the teaching aid 10, with the swim trainee's torso in the central cavity 13 and the swim trainee's face out of the water, enabling the swim trainee to breathe throughout the elementary back stroke.

Figure 16E:
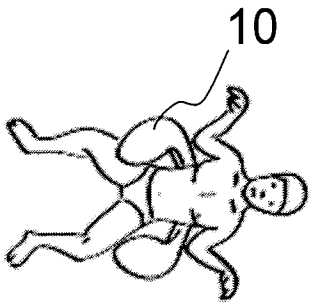
FIG. 16E is an overhead view of a swim trainee performing the third step of practicing the elementary back swimming technique using the teaching aid.
Figure 16B:
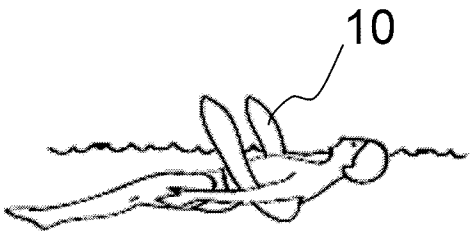
FIG. 16B is a profile view of a swim trainee performing the first step of practicing the elementary back swimming technique using the teaching aid.
Figure 16D:
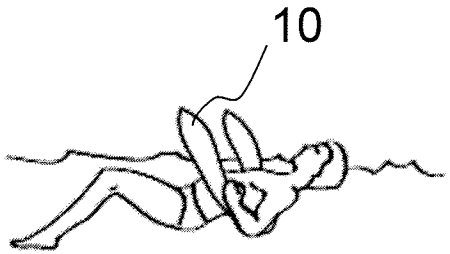
FIG. 16D is a profile view of a swim trainee performing the second step of practicing the elementary back swimming technique using the teaching aid.
Figure 16F:
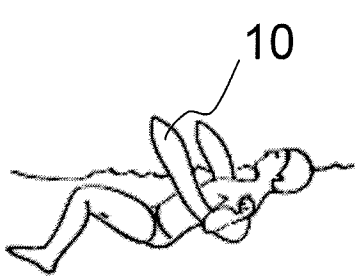
FIG. 16F is a profile view of a swim trainee performing the third step of practicing the elementary back swimming technique using the teaching aid.

In the third step of the elementary back stroke swim technique, the swim trainee, once having brought both hands to approximately inline with the shoulders, extends both hands outward, as is best seen in FIG. 16E. As can be seen from the side view of FIG. 16F, the swim trainees elbows are brought closer in line with the swim trainee's shoulders. The swim trainee's knees are bent at approximately 90 degrees. The legs of the swim trainee are further separated in comparison with step two of the elementary back stroke, as is best seen in FIG. 16E. Similarly to FIG. 16A and FIG. 16B, it can be seen that the front portion 12 of the teaching aid lies beneath the swim trainee, with the swim trainee's torso lying in the central cavity 13. The end portions 14 of the teaching aid 10 may protrude from the surface of the water. The positioning of the teaching aid 10 relative the swim trainee is consistent for the entire elementary back stroke. The teaching aid 10 buoys the body of the swim trainee to a point where the swim trainee does not need to worry about sinking under the surface of the water.

Figure 16G:
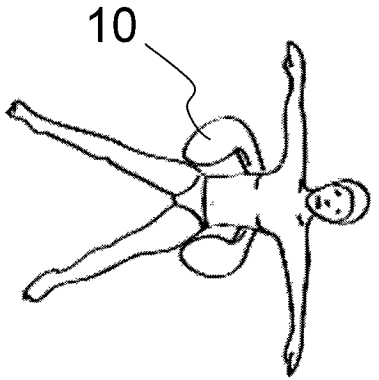
FIG. 16G is an overhead view of a swim trainee performing the fourth step of practicing the elementary back swimming technique using the teaching aid.
Figure 16I:
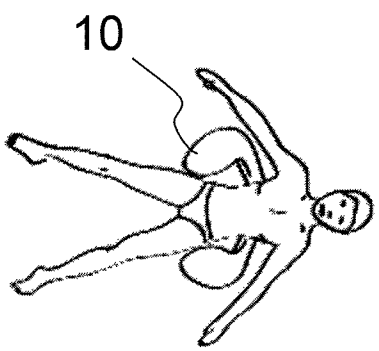
FIG. 16I is an overhead view of a swim trainee performing the fifth step of practicing the elementary back swimming technique using the teaching aid.

In step four of the elementary back stroke, the swim trainee's arms are approximately fully extended and both hands may be inline with the swim trainee's shoulders, as is best seen in FIG. 16G. The swim trainee's hands may also be slightly higher than the swim trainee's shoulders, for example, the swim trainee's hands may be inline with the swim trainee's head. The swim trainee's legs are also approximately fully extended and form an angle of about 45 degrees. As is best seen in FIG. 16H, the teaching aid 10 remains under the swim trainee to support the swim trainee. The swim trainee's body is approximately parallel with the water surface.

Once the swim trainee reaches the fourth step of the elementary back stroke, the swim trainee pivots both arms to a position next to his sides while maintaining both hands in a paddle shape. This motion imparts a momentum to the water opposite to the swim trainee's direction of travel. As can be seen in FIG. 16I, which shows the fifth step of the elementary back stroke, the swim trainee has pivoted both arms approximately halfway to being parallel with the swim trainee's torso. Similarly, the swim trainee's legs are brought together and now form an approximately 30 degree angle. As is seen in FIG. 16J, the swim trainee remains approximately parallel to the surface of the water.

Figure 16K:
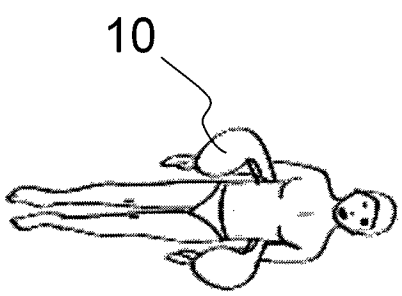
FIG. 16K is an overhead view of a swim trainee performing the sixth step of practicing the elementary back swimming technique using the teaching aid.
Figure 16H:
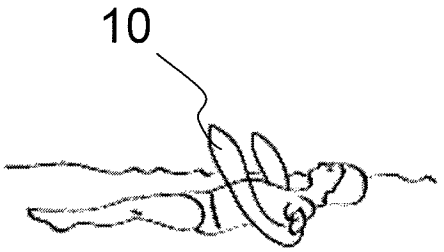
FIG. 16H is a profile view of a swim trainee performing the first fourth of practicing the elementary back swimming technique using the teaching aid.
Figure 16J:
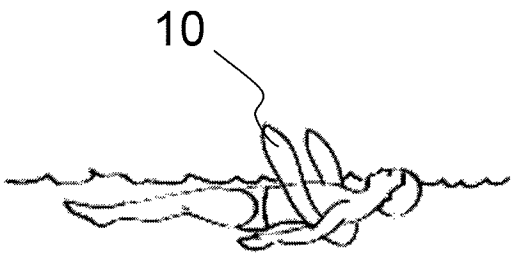
FIG. 16J is a profile view of a swim trainee performing the fifth step of practicing the elementary back swimming technique using the teaching aid.
Figure 16L:
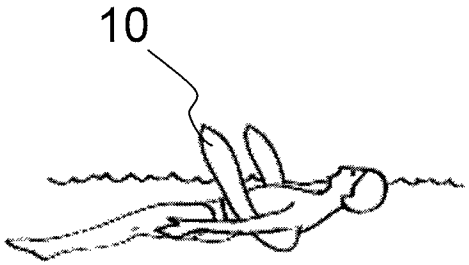
FIG. 16L is a profile view of a swim trainee performing the sixth step of practicing the elementary back swimming technique using the teaching aid.

Turning now to FIG. 16K, the swim trainee is shown with both arms parallel to the swim trainee's torso. Similarly, the swim trainee's legs are parallel and outstretched. The teaching aid 10, remains in the same position as it had throughout the stroke, namely with the union 20 of the front portion 12 behind the swim trainee's lumbar. Throughout the exercise, the end portions 14 may rise above the surface of the water. The swim trainee's arms remain on the outside of the teaching aid 10 while the swim trainee's torso lies in the U-shaped portion. FIG. 16L shows the swim trainee after having completed one period of the elementary back stroke. To continue movement in the direction of the swim trainee's head, the swim trainee repeats each step of the elementary back stroke.

Figure 17A:
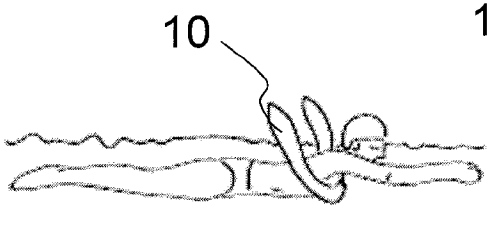
FIG. 17A is a profile view of a swim trainee performing the first step of practicing the breaststroke swimming technique using the teaching aid.
Figure 17B:
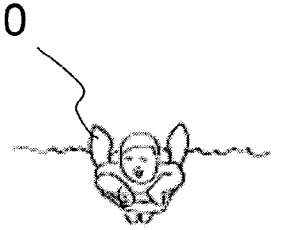
FIG. 17B is a front view of a swim trainee performing the first step of practicing the breaststroke swimming technique using the teaching aid.

Turning to FIG. 17A, the swim trainee is shown in the first step of practicing the breaststroke. The swim trainee begins by lying parallel to the surface of the water with the front portion 12 of the teaching aid 10 under the centre of the swim trainee's chest. The torso of the swim trainee sits in central cavity 13. The end portions 14 of the teaching aid may protrude from the surface of the water. The positioning of the teaching relative to the swim trainee's body does not change for the duration of the stroke. The swim trainee's arms are outstretched and approximately parallel in front of the swim trainee's face. The palms of the swim trainee's hands are facing outward and the hands are parallel and in proximity, as can be seen from the orthogonal view in FIG. 17B. The swim trainee is supported by the teaching aid 10; however, the swim trainee's face is submerged in the water to provide a hydrodynamic form. The swim trainee's legs are outstretched and parallel.

Figure 17G:
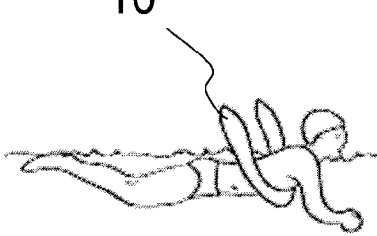
FIG. 17G is a profile view of a swim trainee performing the fourth step of practicing the breaststroke swimming technique using the teaching aid.
Figure 17H:
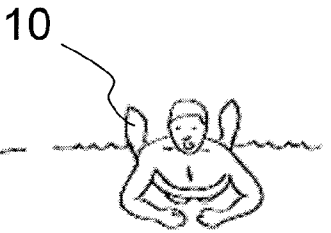
FIG. 17H is a front view of a swim trainee performing the first fourth of practicing the breaststroke swimming technique using the teaching aid.
Figure 17C:
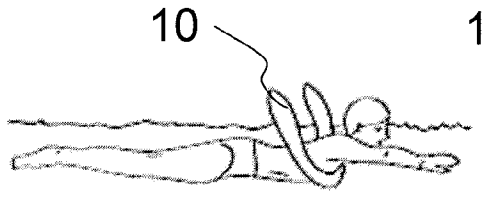
FIG. 17C is a profile view of a swim trainee performing the second step of practicing the breaststroke swimming technique using the teaching aid.
Figure 17D:
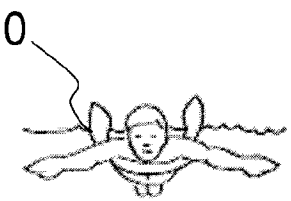
FIG. 17D is a front view of a swim trainee performing the second step of practicing the breaststroke swimming technique using the teaching aid.

FIG. 17C shows the swim trainee in the second step of the breaststroke. The swim trainee has pivoted both arms in approximately 45 degrees of an arc, while maintaining paddle shapes with each hand. The swim trainee's legs remain in generally the same position as in the first step of the breaststroke. As is best seen in FIG. 17D, the swim trainee's arms remain approximately parallel to the surface of the water. The third step of the breaststroke is shown in FIG. 17E. The swim trainee continues to pivot both arms in an arcuate motion about the shoulders, with the upper arms having travelled approximately 60 degrees of an arc in FIG. 17E. The swim trainee's legs are approximately in the same relative position as in steps one and two, however, the swim trainee has pivoted both forearms to moved approximately downward in the water while continuing to pivot both arms backward, as is best seen in FIG. 17F.

Turning now to FIG. 17G, where the swim trainee is performing the fourth step of the breaststroke. The swim trainee has pivoted both arms through at least about 90 degrees of the arc about the shoulders and has brought both hands inwards and approximately underneath the swim trainee's body. The swim trainee's hands may come together below the swim trainee's chin. The swim trainee's knees are slightly bent and the swim trainee has begun to draw both feet in towards the torso. As can be seen in FIG. 17H, the swim trainee's hands are in relatively close proximity beneath the swim trainee's torso. It can be seen that for the first time since beginning the breaststroke, the swim trainee's face is above water. It is during this step that the swim trainee is able to inhale. The swim trainee may exhale throughout the remainder of the steps.

Figure 17I:
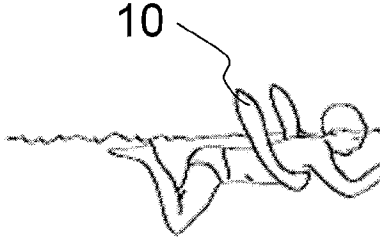
FIG. 17I is a profile view of a swim trainee performing the fifth step of practicing the breaststroke swimming technique using the teaching aid.
Figure 17J:
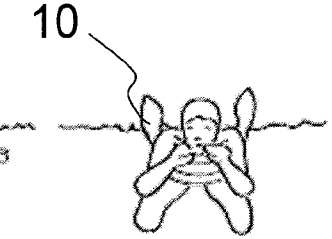
FIG. 17J is a front view of a swim trainee performing the fifth step of practicing the breaststroke swimming technique using the teaching aid.
Figure 17E:
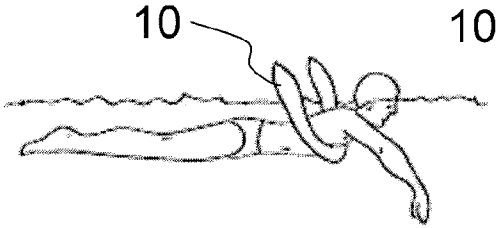
FIG. 17E is a profile view of a swim trainee performing the third step of practicing the breaststroke swimming technique using the teaching aid.
Figure 17F:
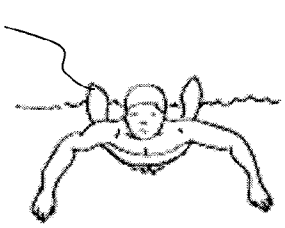
FIG. 17F is a front view of a swim trainee performing the third step of practicing the breaststroke swimming technique using the teaching aid.

In step five, as can be seen in FIG. 17I, the swim trainee's feet have been brought in proximity to the swim trainee's buttocks and both knees are bent at least about 90 degrees. The swim trainee's arms are moving forward with the swim trainee's elbows angled outward in the first step to returning the swim trainee's arms to the position of step one. As can be seen in FIG. 17J, the swim trainee's legs are separated by about 45 degrees and the swim trainee's hands extend to a point. The swim trainee's face is also re-submerged in the water. This position provides the swim trainee with a more hydrodynamic form while being propelled forward through the water.

Figure 17K:
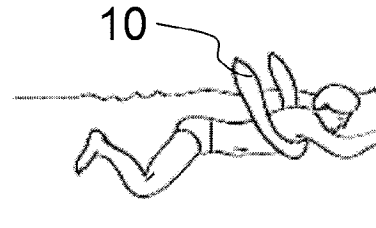
FIG. 17K is a profile view of a swim trainee performing the sixth step of practicing the breaststroke swimming technique using the teaching aid.
Figure 17L:
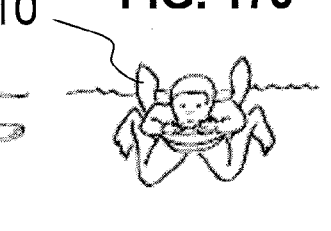
FIG. 17L is a front view of a swim trainee performing the sixth step of practicing the breaststroke swimming technique using the teaching aid.

In the final and sixth step of the backstroke, the swim trainee has begun to kick both legs together, which imparts the water between the legs with a generally backward momentum and propels the swim trainee forward. As is seen in FIG. 17K, the swim trainee's legs are bent at the knees at an approximately 90 degree angle and are returning to the position of FIG. 17A. The swim trainee's arms are also extending forward to return to the position as shown in FIG. 17. As can be seen from FIG. 17L, during the sixth step of the breaststroke, the swim trainee's feet are angled outward and are spaced further apart than the width of the swim trainee's body.

Figure 18A:
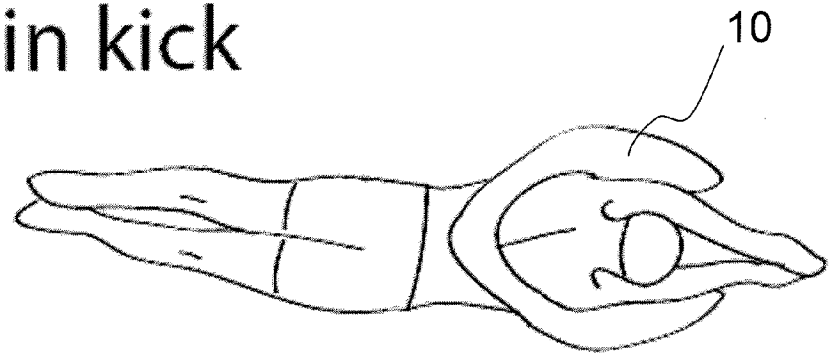
FIG. 18A is an overhead view of a swim trainee performing the first step of practicing the dolphin kick swimming technique using the teaching aid.

Turning now to FIG. 18A, the swim trainee is shown practicing the dolphin kick with help from the buoyancy of the teaching aid 10. The swim trainee's legs and feet are held together and the teaching aid 10 is placed such that the front portion 12 of the teaching aid 10 lies over the spine of the lumbar portion of the swim trainee. The end portions 14 each extend under the swim trainee's shoulders and arms, while the fins 32 support the swim trainee's arms. The swim trainee's upper torso lies in the central cavity 13 of the U-shaped portion of the teaching aid with the swim trainee's head in approximately the plane of the teaching aid 10, as can be seen from FIG. 18B.

Figure 18B:
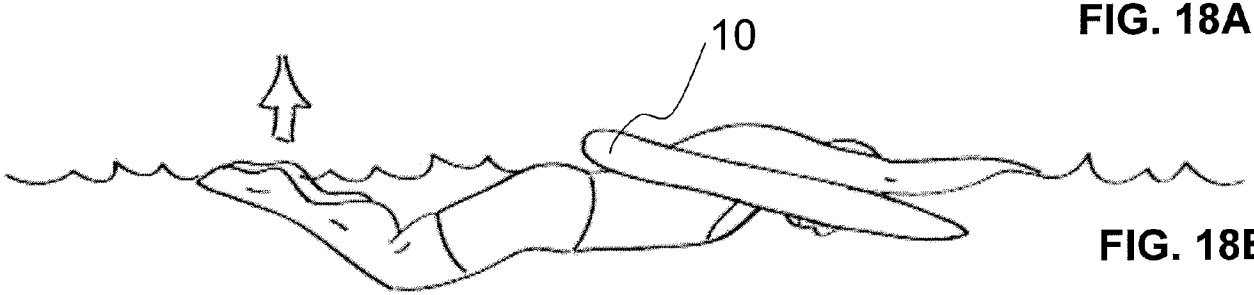
FIG. 18B is a profile view of a swim trainee performing the first step of practicing the dolphin kick swimming technique using the teaching aid.
Figure 18C:
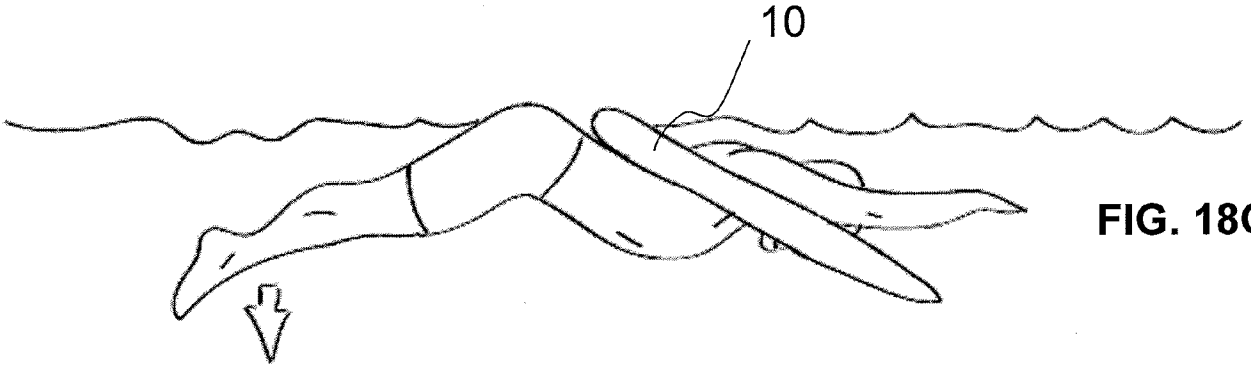
FIG. 18C is a profile view of a swim trainee performing the second step of practicing the dolphin kick swimming technique using the teaching aid.

The first step of the dolphin kick is shown in FIG. 18B, which comprises the swim trainee bending both knees in unison to apply an upward and rearward momentum to the water above the swim trainee's feet. The swim trainee's arms remain supported by the fins 32 of the end portions 14 of the teaching aid 10. In the second step of the dolphin kick, the swim trainee straightens both knees, applying a downward and rearward momentum to the water. The swim trainee also bends at the waist, as seen in FIG. 18C to form an approximately 150 degree angle between the legs and the torso.

Figure 19B:
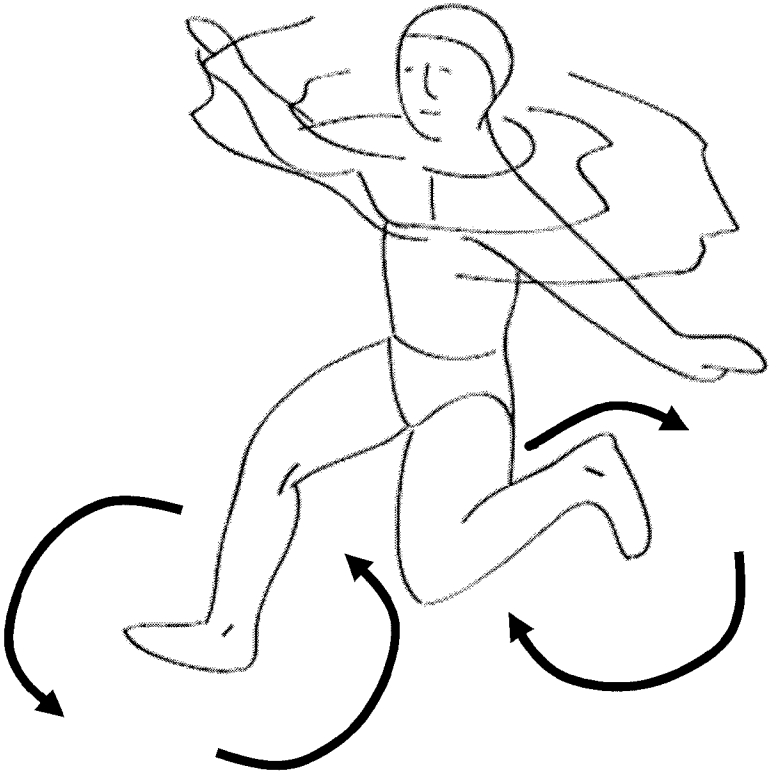
FIG. 19B is a perspective view of a swim trainee performing the eggbeater swimming technique without using the teaching aid.
Figure 19A:
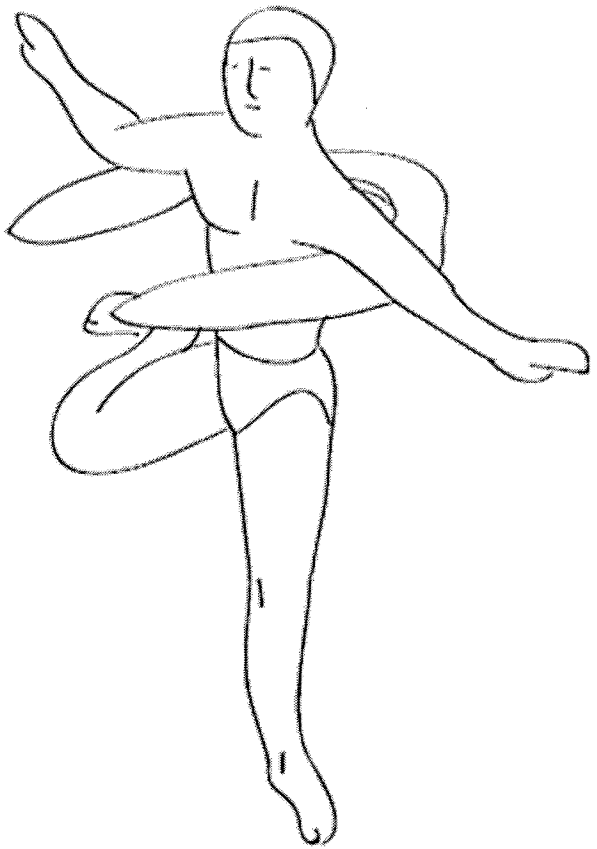
FIG. 19A is a perspective view of a swim trainee performing the eggbeater swimming technique using the teaching aid.

Turning now to FIG. 19A, the swim trainee can be seen using the teaching aid 10 as a buoyancy device while practicing the eggbeater technique. The swim trainee is supported by placing both arms on the surface of the teaching aid 10 at approximately the junctions of the front portion 12 and each of the endpoints 14. The swim trainee may also place both arms on any other portion of the teaching aid 10 that is comfortable. For example, the swim trainee may position both arms on the end portions 14. The swim trainee sits in the central cavity 13 of the teaching aid 10 and is thus able to hold onto any portion of the teaching aid 10 if the swim trainee becomes tired or nervous.

The teaching aid 10 allows the swim trainee's head to remain above the water for easier respiration before the swim trainee's eggbeater technique is sufficient to support the swim trainee completely. To perform the eggbeater technique, the swim trainee is in a sitting position with a straight back. The swim trainee's thighs are approximately parallel to the surface of the water while the swim trainee's lower legs and feet rotate about the knees. The swim trainee's lower legs and feet, as shown in FIG. 19B, pivot about the knees in an approximately circular pattern. The swim trainee pivots both feet continuously and alternately about the knees in an approximately circular approximately 45 degrees from the surface of the water body, the right foot moving in an opposing and intersecting circular path in relation to the left foot. As can be seen from FIG. 19B, the first leg (e.g. the left leg) rotates in a clockwise direction while the second leg (e.g. the right leg) rotates in a counter clockwise direction. The legs do not make contact, as the first leg is close to the axis of the swim trainee's torso while the second leg is extended away from the axis of the swim trainee's torso and vice-versa.

In one example, a teaching aid for use in swim training is provided. The teaching aid may comprise a unitary blow-moulded buoyant body that is approximately U-shaped having an outer perimeter approximately conforming to the shape of a kite. The body defines an opening adapted to receive a torso of a swimmer. The body comprises a pair of end portions, each end portion being tapered to a tip. The end portions comprise inward-facing fins disposed approximately in the plane of the kite.

In another example, the teaching aid may further comprise a union located at the centre of the U-shaped portion, the union having an enlarged cross section. In yet another example, the teaching aid may comprise a blow-moulded polymer. In yet another example, at least a portion of the surface of the outer perimeter of the teaching aide is textured. In yet another example, a portion of the surface of the end portions is textured. In yet another example, the texture is formed during the blow moulding process.

In yet another example, the teaching aid has a tip spacing of approximately 9.5 inches, a fin spacing of approximately 7.75 inches and the thickness of the end portions in the location adjacent to where the fin spacing is measured is approximately 2.7 inches. The width of the teaching aid may be approximately 20 inches and the thickness at the maximum width is approximately 3.45 inches. The length of the teaching aid may be approximately 20 inches. The dimensions of the union may measure approximately 4.5 inches long by 3.45 inches thick. The thickness of the front portion may be approximately 2.9 inches. The kite may comprise two pairs of adjacent sides, each of the first pair of adjacent sides having a length of approximately 12 inches and each of the second pair of adjacent sides having a length of approximately 30 inches.

In another example, a method for using a teaching aid for swimming is provided. The teaching aid comprises a unitary buoyant body that is approximately U-shaped having an outer perimeter approximately conforming to the shape of a kite. The body defines an opening adapted to receive a torso of a swimmer and comprises a pair of end portions joined at a union to form a U-shape, each end portion being tapered to a tip. The end portions further comprise inward-facing fins disposed approximately in the plane of the kite. The method comprises placing the swimmer's torso inside the opening; and placing the arms of the swimmer in a position free to move with respect to the teaching aid.

The example method may further comprise orienting the union under the swimmer's back and lying the swimmer in the water facing upward and outstretching the swimmer's arms. The swimmer's right and left hands are moved towards the swimmer's right and left feet respectively following opposed arcuate paths approximately parallel to the surface of the water. The swimmer's elbows are bent and the swimmer brings both arms up to at least the swimmer's shoulders. The swimmer's arms are then outstretched and the preceding steps are repeated to impart a motive force on the water with respect to the swimmer. The swimmer may also perform a kicking motion to impart a motive force on the water with respect to the swimmer.

The example method may further comprise orienting the union under the swimmer's back lying the swimmer in the water facing upward and balancing on the teaching aid.

The example method may further comprise the steps of orienting the union under the swimmer's abdomen, lying the swimmer in the water facing downward and balancing the swimmer on the teaching aid.

The example method may further comprise the steps of orienting the union under the swimmer's abdomen, lying in the water facing downward and continuously and alternately moving both hands in an approximately circular path in front of the swimmer and perpendicular to the surface of the water. The right hand moves approximately 180 degrees away in the circular path with respect to the left hand. The swimmer may perform a kicking motion to impart a motive force on the water with respect to the swimmer.

In another example method performed using a teaching aid, the teaching aid comprising a unitary buoyant body that is approximately U-shaped having an outer perimeter approximately conforming to the shape of a kite, the body defining an opening adapted to receive a torso of a swimmer. The body comprises a pair of end portions joined at a union to form a U-shape. Each end portion is tapered to a tip. The end portions further comprise inward-facing fins disposed approximately in the plane of the kite. The method comprises lying the swimmer face down in the water and gripping a first end portion of the teaching aid with a first hand of the swimmer. The swimmer's first hand is approximately outstretched on the surface of the water and the second hand of the swimmer is moved relative to the first hand. The second hand moves underneath the swimmer's body in a motion approximately parallel to the surface of the water. The second hand of the swimmer is lifted out of the water approximately adjacent to the swimmer's hip. The swimmer's second hand is moved forward through the air towards the second end portion of the teaching aid, which is gripped with the second hand. The swimmer then releases the grip of the first end portion of the teaching aid with the first hand and grips the second end portion of the teaching aid with the second hand in an outstretched position on the surface of the water. The swimmer moves the first hand relative to the second hand and underneath the swimmer's body and approximately parallel with the surface of the water. The swimmer lifts the first hand out of the water approximately adjacent to the swimmer's hip and reaches forward through the air towards the second end portion of the teaching aid with the first hand. The swimmer releases the grip of the first end portion of the teaching aid with the second hand; and repeats the preceding steps to impart a motive force on the water with respect to the swimmer. The example method may further comprise the step of the swimmer performing a kicking motion to impart a motive force on the water with respect to the swimmer.

In another example method performed using a teaching aid, the teaching aid comprises a unitary buoyant body that is approximately U-shaped having an outer perimeter approximately conforming to the shape of a kite. The body of the teaching aid defines an opening adapted to receive a torso of a swimmer and comprises a pair of end portions joined at a union to form a U-shape, each end portion being tapered to a tip. The end portions further comprise inward-facing fins disposed approximately in the plane of the kite. The method comprises lying the swimmer face up in the water and gripping a first end portion teaching aid with a first hand of the swimmer in an outstretched position approximately adjacent to the swimmer's hips and on the surface of the water. The swimmer's second hand is then moved behind the swimmer's head with a second hand of the swimmer and almost completely extending the arm of the swimmer to which the second hand is connected. The second hand is moved in an arcuate movement approximately parallel to the surface of the water and toward the swimmer's hip. The grip of the first hand on the first end portion is released and the swimmer grips a second end portion of the teaching aid with the second hand in an outstretched position approximately adjacent to the swimmer's hips. The swimmer's first hand is moved behind the head and the arm to which the second hand is connected is almost completely extended. The first hand is moved in an arcuate movement approximately parallel to the surface of the water and toward the swimmer's hip and the grip of the second hand on the second end portion is released. The preceding steps may be repeated to impart a motive force on the water with respect to the swimmer.

The example method may further comprise orienting the union under the swimmer's back, lying the swimmer in the water facing upward and placing both hands of the swimmer near the hips of the swimmer. The legs of the swimmer may be extended to be approximately parallel with the swimmer's knees and bending the knees. The hands of the swimmer may be moved in proximity to their respective armpits of the swimmer in a motion substantially parallel to the sides of the swimmer's torso. The swimmer's elbows may be bent downwards and the swimmer's legs may be bent at the knees and separated. Both hands may be extended outwards from the swimmer's torso and substantially parallel to the surface of the water towards a position wherein both hands are aligned with both of the swimmer's shoulders. Both knees may then be bent to approximately 90 degrees. Both legs may then be extended to be approximately straight and to form an angle of approximately 45 degrees therebetween. The swimmer's hands may be moved in an arcuate motion towards the swimmer's hips with both arms remaining substantially outstretched. The swimmer's legs may be aligned and approximately parallel to the surface of the water. The preceding steps may be repeated to impart a motive force on the water with respect to the swimmer.

The example method may further comprise orienting the union under the swimmer's chest, lying the swimmer in the water facing downward and approximately parallel to the surface of the water and outstretching both arms of the swimmer to be approximately parallel and in close proximity with one another in front of the swimmer's face. The legs of the swimmer may then be outstretched to be approximately parallel and in close proximity with one another. The swimmer's hands may be separated and the arms may be pivoted approximately 45 degrees. The forearms of the swimmer may be pivoted downwards. The hands of the swimmer may then be brought inwards and into close proximity approximately underneath the swimmer's chin. The swimmer's knees may then be bent and the swimmer's legs separated to draw both feet in towards the swimmer's buttocks. The swimmer's hands may be brought together and both of the swimmer's arms may be brought forwards with elbows angled outward. The swimmer's legs may be extended maintaining a separation therebetween. The legs may then be brought together in close proximity. The preceding steps may be repeated to impart a motive force on the water with respect to the swimmer.

In another example method performed using a teaching aid, the teaching aid comprises a unitary buoyant body that is approximately U-shaped having an outer perimeter approximately conforming to the shape of a kite. The body of the teaching aid defines an opening adapted to receive a torso of a swimmer and comprises a pair of end portions joined at a union to form a U-shape, each end portion being tapered to a tip. The end portions further comprise inward-facing fins disposed approximately in the plane of the kite. The method comprises placing the swimmer's torso inside the opening, orienting the union on the swimmer's upper back and placing a first arm of the swimmer on a first fin and a second arm of the swimmer on the second fin, lying the swimmer in the water facing downward. The swimmer's legs and the swimmer's feet are brought in contact and both knees of the swimmer in unison to apply an upward and rearward moment to the water above the swimmer's feet. The swimmer's knees may then be straightened to apply a downward momentum to the water. The swimmer's waist may be bent to form an approximately 150 degree angle between the legs and the torso. The preceding steps may be repeated to impart a motive force on the water with respect to the swimmer.

In another example method performed using a teaching aid, the teaching aid comprises a unitary buoyant body that is approximately U-shaped having an outer perimeter approximately conforming to the shape of a kite. The body of the teaching aid defines an opening adapted to receive a torso of a swimmer and comprises a pair of end portions joined at a union to form a U-shape, each end portion being tapered to a tip. The end portions further comprise inward-facing fins disposed approximately in the plane of the kite. The method comprises placing the swimmer's torso inside the opening, orienting the union on the swimmer's upper back, the swimmer being oriented perpendicular to the water surface. Each of the swimmer's arms are supported by a fin of the teaching aid. The swimmer continuously and alternately pivoting both of the feet about the knees in an approximately circular approximately 45 degrees from the surface of the water, the right foot of the swimmer moving in an opposing and intersecting circular path in relation to the left foot of the swimmer.

Although the above has been described with reference to certain specific example embodiments, various modifications thereof will be apparent to those skilled in the art without departing from the scope of the claims appended hereto.

We claim:

1. A teaching aid for use in swim training, the teaching aid comprising:

a unitary blow-moulded buoyant body that is approximately U-shaped having an outer perimeter approximately conforming to the shape of a kite, the body defining an opening adapted to receive a torso of a swimmer, the body comprising a pair of end portions, each end portion being tapered to a tip, the end portions further comprising inward-facing fins disposed approximately in the plane of the kite.

2. The teaching aid of claim 1, the teaching aid further comprising a union located at the centre of the U-shaped portion, the union having an enlarged cross section.

3. The teaching aid of claim 1 wherein the teaching aid comprises a blow-moulded polymer.

4. The teaching aid of claim 1 wherein at least a portion of the surface of the outer perimeter of the teaching aide is textured.

5. The teaching aid of claim 4 wherein the texture is formed during the blow moulding process.

6. The teaching aid of claim 1 wherein a portion of the surface of the end portions is textured.

7. The teaching aid of claim 1 wherein:

a) the teaching aid has a tip spacing of approximately 9.5 inches;

b) the teaching aid has a fin spacing of approximately 7.75 inches and the thickness of the end portions in the location adjacent to where the fin spacing is measured is approximately 2.7 inches;

c) the width of the teaching aid is approximately 20 inches and the thickness at the maximum width is approximately 3.45 inches;

d) the length of the teaching aid is approximately 20 inches;

e) the dimensions of the union measure approximately 4.5 inches long by 3.45 inches thick;

f) the thickness of the front portion is approximately 2.9 inches; and g) the kite comprises two pairs of adjacent sides, each of the first pair of adjacent sides having a length of approximately 12 inches and each of the second pair of adjacent sides having a length of approximately 30 inches.

8. A method for using a teaching aid for swimming, the teaching aid comprising a unitary buoyant body that is approximately U-shaped having an outer perimeter approximately conforming to the shape of a kite, the body defining an opening adapted to receive a torso of a swimmer, the body comprising a pair of end portions joined at a union to form a U-shape, each end portion being tapered to a tip, the end portions further comprising inward-facing fins disposed approximately in the plane of the kite, the method comprising:

a) placing the swimmer's torso inside the opening; and b) placing the arms of the swimmer in a position free to move with respect to the teaching aid.

9. The method of claim 8 further comprising:

a) orienting the union under the swimmer's back;

b) lying the swimmer in the water facing upward;

c) outstretching both the arms;

d) moving the swimmer's right and left hands towards the swimmer's right and left feet respectively following opposed arcuate paths approximately parallel to the surface of the water;

e) bending both of the swimmer's elbows and bringing both the arms up to at least the swimmer's shoulders;
f) outstretching the arms; and
g) repeating steps d and f to impart a motive force on the water with respect to the swimmer.

10. The method of claim 9 further comprising the step of the swimmer performing a kicking motion to impart a motive force on the water with respect to the swimmer.

11. The method of claim 8 further comprising;
a) orienting the union under the swimmer's back;
b) lying the swimmer in the water facing upward; and
c) balancing on the teaching aid.

12. The method of claim 8 further comprising:
a) orienting the union under the swimmer's abdomen;
b) lying the swimmer in the water facing downward; and
c) balancing the swimmer on the teaching aid.

13. The method of claim 8 further comprising:
a) orienting the union under the swimmer's abdomen;
b) lying in the water facing downward; and
c) continuously and alternately moving both hands in an approximately circular path in front of the swimmer and perpendicular to the surface of the water, the right hand moving approximately 180 degrees of the circular path from the left hand.

14. The method of claim 13 further comprising the step of the swimmer performing a kicking motion to impart a motive force on the water with respect to the swimmer.

15. The method of claim 8 further comprising:
a) orienting the union under the swimmer's back;
b) lying the swimmer in the water facing upward;
c) placing both hands of the swimmer near the hips of the swimmer;
d) extending both legs of the swimmer to be approximately parallel with the swimmer's knees and bending the knees;
e) moving the hands in proximity to their respective armpits of the swimmer in a motion substantially parallel to the sides of the swimmer's torso;
f) bending both elbows of the swimmer downwards;
g) bending both legs at the knees and separating the legs from each other;
h) extending both hands outwards from the swimmer's torso and substantially parallel to the surface of the water towards a position wherein both hands are aligned with both of the swimmer's shoulders;
i) bending both knees to approximately 90 degrees;
j) extending both legs approximately straight and to form an approximately 45 degree angle therebetween;
k) moving both hands in an arcuate motion towards the swimmer's hips with both arms remaining substantially outstretched;
l) moving both legs to be aligned and approximately parallel to the surface of the water; and
m) repeating steps d to l to impart a motive force on the water with respect to the swimmer.

16. The method of claim 8 further comprising:
a) orienting the union under the swimmer's chest;
b) lying the swimmer in the water facing downward and approximately parallel to the surface of the water;
c) outstretching both arms of the swimmer to be approximately parallel and in close proximity with one another in front of the swimmer's face;
d) outstretching both legs of the swimmer to be approximately parallel and in close proximity with one another;
e) separating both hands of the swimmer and pivoting both arms by approximately 45 degrees;
f) pivoting both forearms of the swimmer downwards;
g) bringing both hands inwards and into close proximity approximately underneath the swimmer's chin;
h) bending the swimmer's knees and separating the legs to draw both feet in towards the swimmer's buttocks;
i) moving both hands together and moving both arms forwards with elbows angled outward;
j) extending both legs while maintaining a separation;
k) bringing both legs together in close proximity; and
l) repeating steps c to k to impart a motive force on the water with respect to the swimmer.

17. A method for using a teaching aid for swimming, the teaching aid comprising a unitary buoyant body that is approximately U-shaped having an outer perimeter approximately conforming to the shape of a kite, the body defining an opening adapted to receive a torso of a swimmer, the body comprising a pair of end portions joined at a union to form a U-shape, each end portion being tapered to a tip, the end portions further comprising inward-facing fins disposed approximately in the plane of the kite, the method comprising:
a) lying the swimmer face down in the water;
b) gripping a first end portion of the teaching aid with a first hand of the swimmer;
c) outstretching the first hand approximately on the surface of the water;
d) moving a second hand of the swimmer relative to the first hand and underneath the swimmer's body and approximately parallel with the surface of the water;
e) lifting the second hand out of the water approximately adjacent to the swimmer's hip;
f) moving the second hand forward through the air towards the second end portion of the teaching aid;
g) releasing the grip of the first end portion of the teaching aid with the first hand;
h) gripping the second end portion of the teaching aid with the second hand in an outstretched position on the surface of the water;
i) moving the first hand relative to the second hand and underneath the swimmer's body and approximately parallel with the surface of the water;
j) lifting the first hand out of the water approximately adjacent to the swimmer's hip;
k) moving the first hand forward through the air towards the second end portion of the teaching aid;
l) releasing the grip of the first end portion of the teaching aid with the second hand; and
m) repeating steps c to l to impart a motive force on the water with respect to the swimmer.

18. The method of claim 17 further comprising the step of the swimmer performing a kicking motion to impart a motive force on the water with respect to the swimmer.

19. A method for using a teaching aid for swimming, the teaching aid comprising a unitary buoyant body that is approximately U-shaped having an outer perimeter approximately conforming to the shape of a kite, the body defining an opening adapted to receive a torso of a swimmer, the body comprising a pair of end portions joined at a union to form a U-shape, each end portion being tapered to a tip, the end portions further comprising inward-facing fins disposed approximately in the plane of the kite, the method comprising:
a) lying the swimmer face up in the water;
b) gripping a first end portion teaching aid with a first hand of the swimmer in an outstretched position approximately adjacent to the swimmer's hips and on the surface of the water;

c) moving a second hand of the swimmer behind the swimmer's head and almost completely extending the arm of the swimmer to which the second hand is connected;

d) moving the second hand in an arcuate movement approximately parallel to the surface of the water and toward the swimmer's hip;

e) releasing the grip of the first hand on the first end portion;

f) gripping a second end portion of the teaching aid with the second hand in an outstretched position approximately adjacent to the swimmer's hips;

g) moving the first hand behind the head and almost completely extending the arm to which the first hand is connected;

h) moving the first hand in an arcuate movement approximately parallel to the surface of the water and toward the swimmer's hip;

i) releasing the grip of the second hand on the second end portion; and j) repeating steps b to i to impart a motive force on the water with respect to the swimmer.

20. A method for using a teaching aid for swimming, the teaching aid comprising a unitary buoyant body that is approximately U-shaped having an outer perimeter approximately conforming to the shape of a kite, the body defining an opening adapted to receive a torso of a swimmer, the body comprising a pair of end portions joined at a union to form a U-shape, each end portion being tapered to a tip, the end portions further comprising inward-facing fins disposed approximately in the plane of the kite, the method comprising:

a) placing the swimmer's torso inside the opening;

b) orienting the union on the swimmer's upper back and placing a first arm of the swimmer on a first fin and a second arm of the swimmer on the second fin;

c) lying the swimmer in the water facing downward;

d) placing both the swimmer's legs and the swimmer's feet in contact;

e) bending both knees of the swimmer in unison to apply an upward and rearward moment to the water above the swimmer's feet;

f) straightening both knees of the swimmer to apply a downward momentum to the water;

g) bending the waist of the swimmer to form an approximately 150 degree angle between the legs and the torso; and h) repeating steps d to f to impart a motive force on the water with respect to the swimmer.

21. A method for using a teaching aid for swimming, the teaching aid comprising a unitary buoyant body that is approximately U-shaped having an outer perimeter approximately conforming to the shape of a kite, the body defining an opening adapted to receive a torso of a swimmer, the body comprising a pair of end portions joined at a union to form a U-shape, each end portion being tapered to a tip, the end portions further comprising inward-facing fins disposed approximately in the plane of the kite, the method comprising:

a) placing the swimmer's torso inside the opening;

b) orienting the union on the swimmer's upper back, the swimmer being oriented perpendicular to the water surface;

c) supporting each of the swimmer's arms on a fin of the teaching aid; and d) continuously and alternately pivoting both of the swimmer's feet about the knees of the swimmer in an approximately circular approximately 45 degrees from the surface of the water, the right foot of the swimmer moving in an opposing and intersecting circular path in relation to the left foot of the swimmer.

* * * * *